US010702122B2

(12) United States Patent
Lee et al.

(10) Patent No.: US 10,702,122 B2
(45) Date of Patent: Jul. 7, 2020

(54) DISHWASHER AND METHOD FOR CONTROLLING SAME

(71) Applicant: SAMSUNG ELECTRONICS CO., LTD., Suwon-si, Gyeonggi-do (KR)

(72) Inventors: Chang Wook Lee, Seoul (KR); Sang Soo Choi, Taebaek-si (KR); Seung Gee Hong, Suwon-si (KR); Jun Ho Lee, Daegu (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 769 days.

(21) Appl. No.: 15/108,676

(22) PCT Filed: Dec. 30, 2014

(86) PCT No.: PCT/KR2014/013017
§ 371 (c)(1),
(2) Date: Jun. 28, 2016

(87) PCT Pub. No.: WO2015/102358
PCT Pub. Date: Jul. 9, 2015

(65) Prior Publication Data

US 2016/0316992 A1 Nov. 3, 2016

(30) Foreign Application Priority Data

Dec. 31, 2013 (KR) ..... 10-2013-0169375

(51) Int. Cl.
*A47L 15/42* (2006.01)
*A47L 15/00* (2006.01)
(Continued)

(52) U.S. Cl.
CPC ..... *A47L 15/4282* (2013.01); *A47L 15/0052* (2013.01); *A47L 15/16* (2013.01);
(Continued)

(58) Field of Classification Search
None
See application file for complete search history.

(56) References Cited

U.S. PATENT DOCUMENTS 2,236,791 A * 4/1941 Forsberg ..... A47L 15/18 134/172
3,177,095 A * 4/1965 Gibson ..... A47L 15/20 134/25.2
(Continued)

FOREIGN PATENT DOCUMENTS

CN 202960423 6/2013
CN 103462574 12/2013
(Continued)

OTHER PUBLICATIONS

Written Opinion of the International Searching Authority (Form PCT/ISA/237); dated Apr. 8, 2015 in corresponding International Patent Application No. PCT/KR2014/013017 (7 pages) (10 pages English Translation).
(Continued)

*Primary Examiner* — Michael E Barr
*Assistant Examiner* — Jason P Riggleman
(74) *Attorney, Agent, or Firm* — Staas & Halsey LLP

(57) ABSTRACT

Disclosed is a dishwasher comprising: a tub for containing dishes; a nozzle assembly for ejecting washing water; a vane assembly for changing the path of the washing water, while moving from a first position to a second position inside the tub, such that the ejected washing water is directed towards the dishes; and a controller for stopping the vane assembly, changing the movement speed of the vane assembly, or changing the movement direction of the vane assembly while the vane assembly moves from the first position to the second position, wherein the washing water can also be ejected to corner portions of the tub.

8 Claims, 26 Drawing Sheets

(51) Int. Cl.
*A47L 15/16* (2006.01)
*A47L 15/18* (2006.01)

(52) U.S. Cl.
CPC ..... *A47L 15/18* (2013.01); *A47L 15/4217* (2013.01); *A47L 15/4221* (2013.01); *A47L 2401/32* (2013.01); *A47L 2501/03* (2013.01); *A47L 2501/20* (2013.01)

(56) References Cited

U.S. PATENT DOCUMENTS

| | | | | |
|---|---|---|---|---|
| 10,034,595 | B2 * | 7/2018 | Park | A47L 15/16 |
| 2009/0056754 | A1 | 3/2009 | Rolek | |
| 2012/0031432 | A1 | 2/2012 | Beaudet et al. | |
| 2012/0097199 | A1 | 4/2012 | Tuller | |
| 2013/0319487 | A1 | 12/2013 | Hong et al. | |
| 2015/0128999 | A1 * | 5/2015 | Park | A47L 15/16<br>134/25.2 |

FOREIGN PATENT DOCUMENTS

| | | | |
|---|---|---|---|
| DE | 19618498 | A1 | 11/1997 |
| EP | 2807970 | A1 | 3/2014 |
| JP | 2008-279137 | A | 11/2008 |
| KR | 0144159 | | 7/1998 |
| KR | 1001602450000 | | 8/1998 |
| WO | WO 2015/102358 | A1 | 9/2015 |

OTHER PUBLICATIONS

International Search Report (Form PCT/ISA/210); dated Apr. 8, 2015 in corresponding International Patent Application No. PCT/KR2014/013017 (3 pages) (2 pages English Translation).

Extended European Search report dated Aug. 18, 2017 in corresponding European Patent Application No. 14876445.9.

European Communication dated Sep. 7, 2018 in European Patent Application No. 14876445.9.

Chinese Office Action dated Jun. 20, 2018 in Chinese Patent Application No. 201480076126.5.

European Communication dated Jul. 19, 2019 in corresponding European Patent Application No. 14876445.9.

Korean Office Action dated Sep. 10, 2019 in corresponding Korean Patent Application No. 10-2013-0169375.

Chinese Office Action dated Apr. 23, 2019 in Chinese Patent Application No. 201480076126.5.

* cited by examiner

DISHWASHER AND METHOD FOR CONTROLLING SAME

CROSS-REFERENCE TO RELATED APPLICATIONS

This application is a U.S. national stage application of PCT international application PCT/KR2014/013017, filed on Dec. 30, 2014 and claims the benefit of Korean Patent Application No. 10-2013-0169375, filed on Dec. 31, 2013, respectively, the contents are incorporated herein by reference.

BACKGROUND

1. Technical Field

The present disclosure is related to a dishwasher and a control method thereof, and more particularly, to a dishwasher including a vane that changes a trajectory of sprayed washing water toward dishes and a control method thereof.

2. Background Art

In general, a dishwasher is an apparatus that sprays high pressure washing water to dishes, washes the dishes, and conventionally performs a washing process and a rinsing process. In the washing process, the washing water is sprayed and a detergent is supplied at the same time by a detergent supply device to wash the dishes.

In general, a dishwasher includes a cabinet in which a washing tub is provided therein, a pump that generates a pressure of washing water, a basket installed therein to accommodate dishes and move forward and backward in the washing tub, nozzle assemblies which spray the washing water toward the dish basket, connecting flow paths which connect the pump and the nozzle assemblies, and flow path switching valves configured to selectively move the washing water from the pump to a plurality of nozzle assemblies, wherein the washing water sprayed by the nozzle assemblies washes the dishes.

Conventionally, the nozzle assemblies are rotary type nozzle assemblies positioned above and under an upper dish basket, and above a lower dish basket. Such a rotary type spray unit is rotated by a reaction of spraying high pressure washing water. However, when the nozzle assemblies are provided to rotate, there are dead zones where the washing water cannot reach at corners of a washing tub provided in a quadrangular shape.

SUMMARY

One embodiment of the present disclosure is directed to providing a dishwasher that sprays washing water to corners of a tub and a control method thereof.

Another embodiment of the present disclosure is directed to providing a dishwasher that improves dishwashing capability and a control method thereof.

Still another embodiment of the present disclosure is directed to providing a dishwasher that lessens noise due to dishwashing.

One aspect of the present invention provides a dishwasher including a tub that accommodates a dish, a nozzle assembly that sprays washing water, a vane assembly that changes a trajectory of the washing water so that the sprayed washing water faces the dish while moving from a first position to a second position in the tub, and a controller that stops the vane assembly, changes a movement speed of the vane assembly, or changes a movement direction of the vane assembly while the vane assembly is moving from the first position and the second position.

When the vane assembly reaches the second position, the controller may move the vane assembly from the second position to the first position.

The controller may control the vane assembly to move the vane assembly for a first time duration in a forward direction and for a second time duration in a backward direction.

The first time duration may be less than a reference time for which the vane assembly moves from the first position to the second position.

The second time duration may be less than the first time duration.

The controller may control the vane assembly to move the vane assembly for a third time duration and to stop the vane assembly for a fourth time duration.

The third time duration may be less than a reference time for which the vane assembly moves from the first position to the second position.

The vane assembly may change the trajectory of the washing water toward a dish accommodated at a position corresponding to the nozzle assembly when positioned in a vane rotation section.

When the vane assembly is positioned in the vane rotation section, the controller may control the vane assembly to repeat moving and stopping of the vane assembly.

When the vane assembly is positioned in the vane rotation section, the controller may reduce the movement speed of the vane assembly.

When the vane assembly moves forward and backward between the first position and the second position, the controller may control the vane assembly to move the vane assembly forward and backward in the vane rotation section.

The dishwasher may further include a vibration detector that detects a vibration of the dishwasher When the vibration of the dishwasher is a reference value or more, the controller may move the vane assembly from the first position to a third position.

The nozzle assembly may include a plurality of spray nozzles and a distribution valve that distributes the washing water to the plurality of spray nozzles.

When a distribution of the washing water by the distribution valve is changed, the controller may control the vane assembly to be positioned within a predetermined distance from the nozzle assembly.

Another aspect of the present invention provides a control method of a dishwasher including moving a vane assembly that changes a trajectory of washing water sprayed by a nozzle assembly from a first position to a second position, wherein the moving of the vane assembly from the first position to the second position includes, stopping the vane assembly, changing a movement speed of the vane assembly, or changing a movement direction of the vane assembly.

The control method may further include moving the vane assembly from the second position to the first position when the vane assembly reaches the second position.

The moving of the vane assembly from the first position to the second position may include moving the vane assembly for a first time duration in a forward direction, and moving the vane assembly for a second time duration in a backward direction.

The first time duration may be less than a reference time for which the vane assembly moves from the first position to the second position.

The second time duration may be less than the first time duration.

The moving of the vane assembly from the first position to the second position may include moving the vane assembly for a third time duration, and stopping the vane assembly for a fourth time duration.

The third time duration may be less than a reference time for which the vane assembly moves from the first position to the second position.

A vane movement section between the first position and the second position may include a vane rotation section in which the vane assembly changes the trajectory of the washing water toward a dish accommodated at a position corresponding to the nozzle assembly.

The control method may further include repeating moving and stopping of the vane assembly when the vane assembly is positioned in the vane rotation section.

The control method may further include reducing the movement speed of the vane assembly when the vane assembly is positioned in the vane rotation section.

According to one embodiment of the present disclosure, a dishwasher including a vane that changes a trajectory of washing water while moving between one side and the other side of a tub can also spray washing water to corner portions of the tub.

According to another embodiment of the present disclosure, dishwashing capability can be improved by controlling a movement, a movement direction, and a movement speed of the vane.

According to still another embodiment of the present disclosure, noise due to dishwashing can be lessened by changing a movement section of the vane.

DESCRIPTION OF EMBODIMENTS

Embodiments described in this specification and configurations illustrated in drawings are only exemplary examples of the disclosed disclosure, and the disclosure covers variously modified embodiments that can substitute for the embodiments herein and drawings at the time of filing of this application.

Hereinafter, a dishwasher according to one embodiment will be described in detail with reference to the accompanying drawings.

Figure 1:
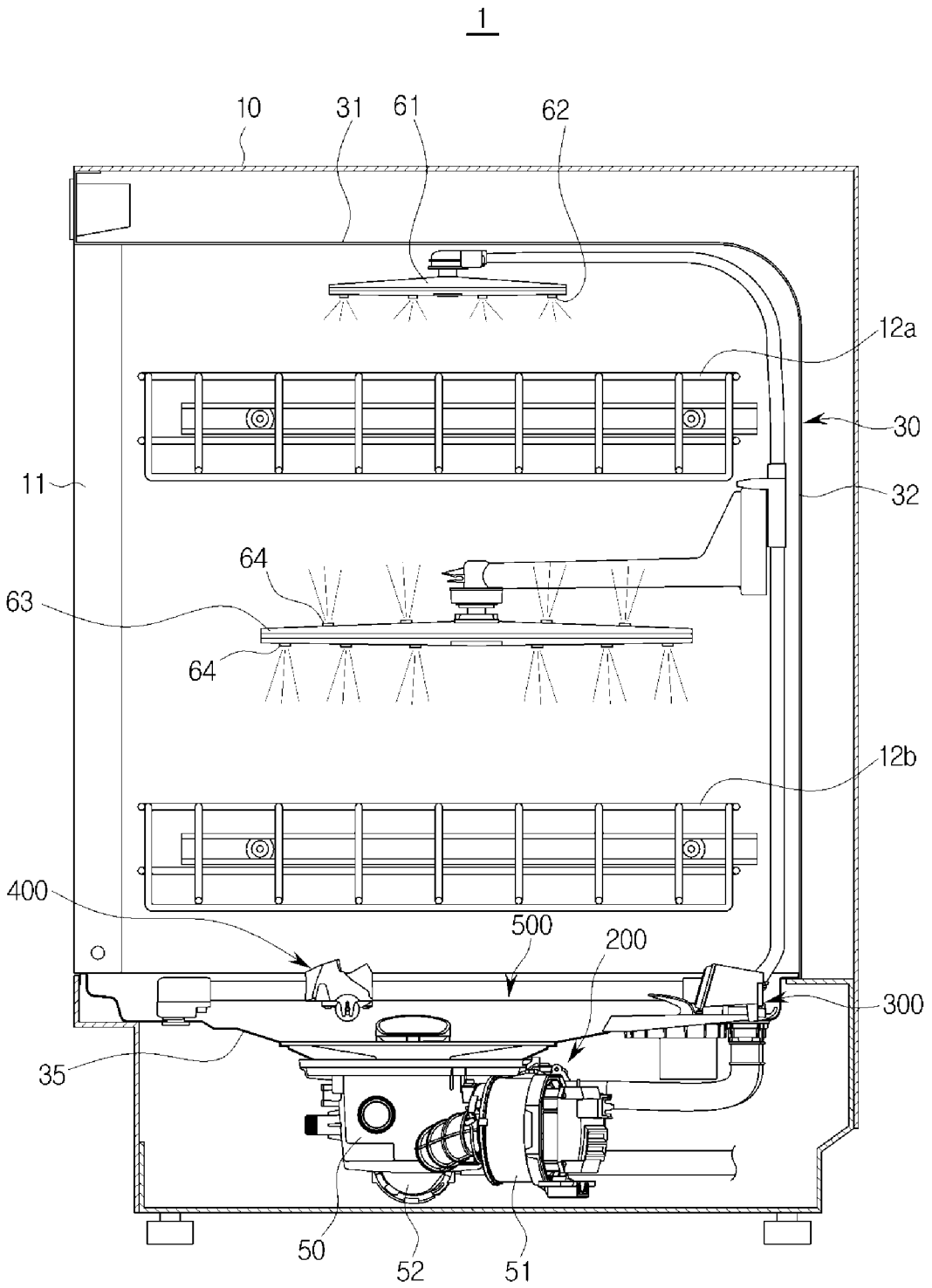
FIG. 1 is a view illustrating a dishwasher according to one embodiment.
Figure 2:
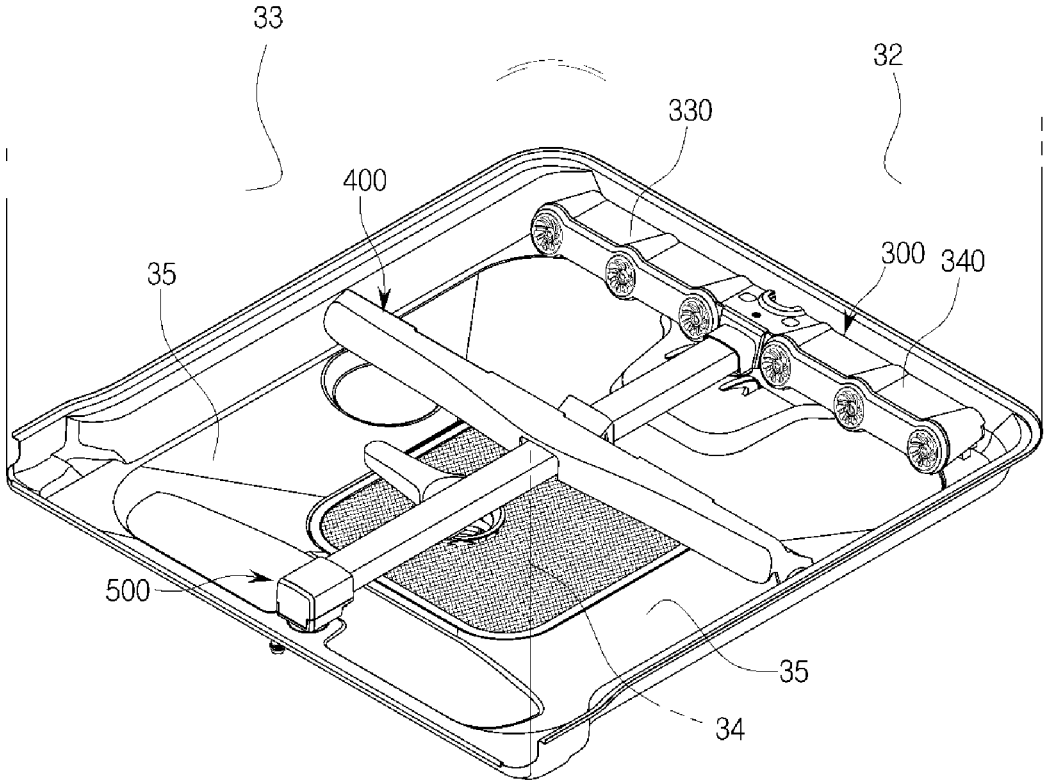
FIG. 2 is a view illustrating a lower portion of the dishwasher according to one embodiment.

FIG. 1 is a view illustrating a dishwasher according to one embodiment, and FIG. 2 is a view illustrating a lower portion of the dishwasher according to one embodiment.

First, a schematic configuration of a dishwasher 1 will be described with reference to FIGS. 1 and 2.

The dishwasher includes a main body 10 forming an exterior thereof, a tub provided in the main body 10, baskets 12*a* and 12*b* provided in the tub 30 to store dishes, rotary spray nozzles 61 and 63 and a fixed nozzle assembly 300 that spray washing water, a sump 50 which stores washing water, a circulation pump 51 that supplies washing water in the sump 50 to the rotary spray nozzles 61 and 63 and the fixed nozzle assembly 300, a distribution valve assembly 200 that distributes washing water to the rotary spray nozzle 61 and 63 and the fixed nozzle assembly 300, a drain pump 52 that discharges the washing water in the sump 50 with scraps to the outside of the main body 10, a vane assembly 400 that reflects washing water toward dishes while moving in the tub 30, and a vane driving assembly 500 that drives the vane assembly 400.

The tub 30 may have a box shape in which the front is opened to deposit or withdraw dishes. The open front of the tub 30 may be opened and closed by a door 11. The tub 30 may include an upper wall 31, a rear wall 32, a left wall 33, a right wall 34, and a bottom plate 35.

The baskets 12*a* and 12*b* may be wire racks formed with wires through which washing water passes not to be collected therein. The baskets 12*a* and 12*b* may be detachably provided in the tub. The baskets 12*a* and 12*b* may include an upper basket 12*a* disposed at an upper portion of the tub 30 and a lower basket 12*b* disposed at a lower portion of the tub 30.

The rotary spray nozzles 61 and 63 may spray washing water at a high pressure to wash dishes and include an upper rotary nozzle 61 provided at the upper portion of the tub 30 and a central rotary nozzle 63 provided at a central portion of the tub 30.

The rotary spray nozzles 61 and 63 spray washing water through spray holes 62 and 64 respectively formed at the upper rotary nozzle 61 and the central rotary nozzle 63, and rotate by a reaction of spraying the washing water.

The fixed nozzle assembly 300 is provided at a lower portion so as not to move unlike the rotary spray nozzles 61 and 63, and is fixed to one side of the tub 30. The fixed nozzle assembly 300 may be disposed adjacent to the rear wall 32 of the tub 30 and may spray washing water toward the front of the tub 30. Accordingly, the washing water sprayed by the fixed nozzle assembly 300 may not be directly sprayed toward dishes.

Such a fixed nozzle assembly 300 may include a left fixed nozzle 330 disposed at a left side of the tub 30 and a right fixed nozzle 340 disposed at a right side of the tub 30.

Washing water sprayed by the fixed nozzle assembly 300 may be reflected toward dishes by a vane assembly 400. The fixed nozzle assembly 300 may be disposed below the lower basket 12*b* and the vane assembly 400 may reflect washing water sprayed by the fixed nozzle assembly 300 upward.

The vane assembly 400 may include a vane 410 lengthily extending in left and right directions of the tub 30 to reflect all washing water sprayed by the fixed nozzle assembly 300. Such a vane 410 may linearly move forward and backward in a direction of washing water being sprayed by the fixed nozzle assembly 300. That is, the vane 410 may linearly move forward and backward in forward and backward directions of the tub 30.

Accordingly, a linear spray structure including the fixed nozzle assembly 300 and the vane assembly 400 may wash an entire area of the tub 30 with no dead zones.

The distribution valve assembly 200 distributes washing water so that the rotary spray nozzles 61 and 63 and the fixed nozzle assembly 300 may independently spray the washing water. Furthermore, the distribution valve assembly 200 distributes the washing water so that the left fixed nozzle 330 and the right fixed nozzle 340 of the fixed nozzle assemble 300 may also independently spray the washing water.

Accordingly, the dishwasher may independently and separately wash the left and right sides of the tub 30. However, unlike one embodiment, the dishwasher may also subdivide the tub 30 as necessary as well as dividing the tub 30 only into the left and the right of the tub 30.

Hereinafter main components of the dishwasher according to one embodiment will be described in order.

Figure 3:
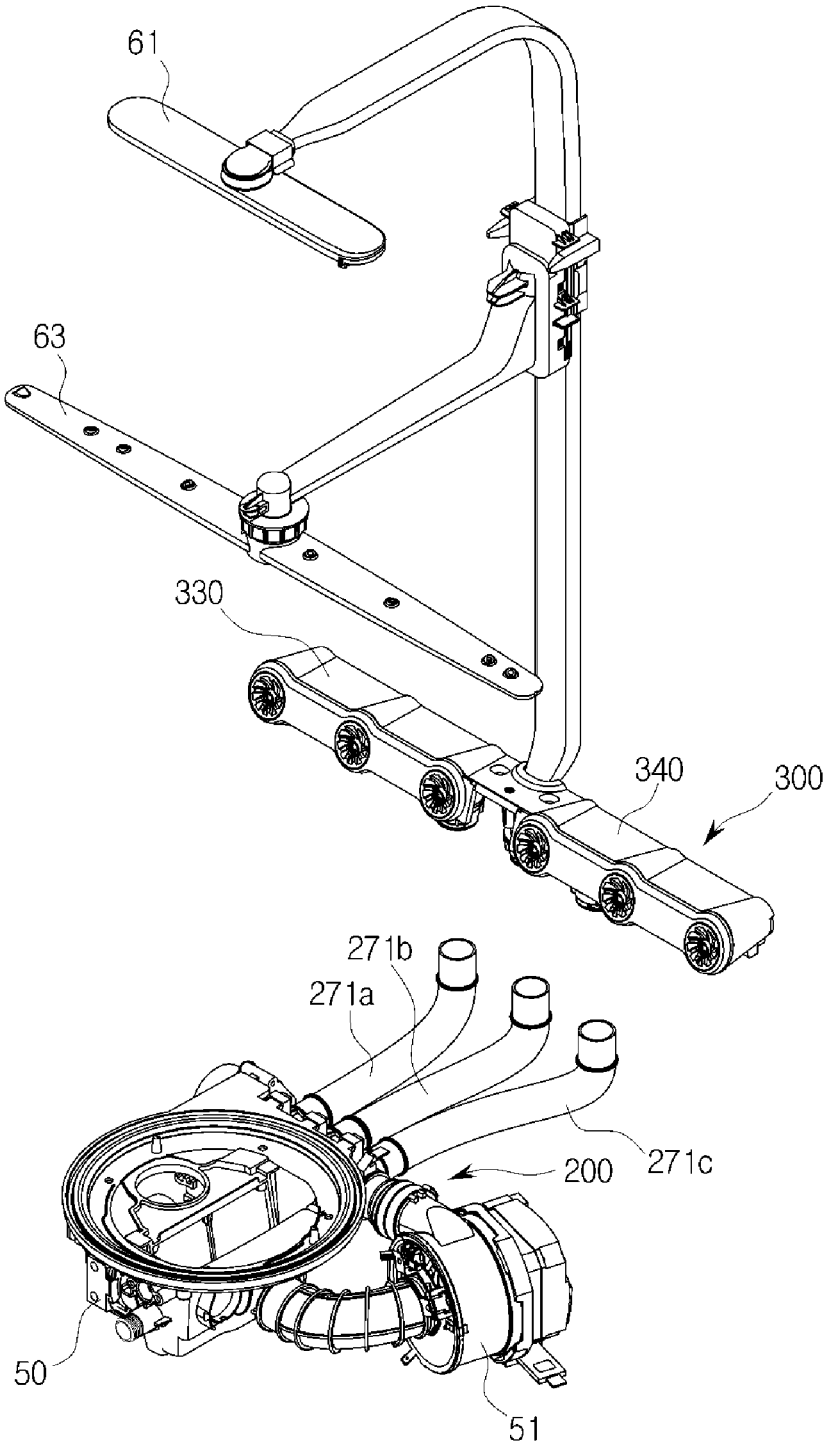
FIG. 3 is a view illustrating a structure of the dishwasher according to one embodiment.

FIG. 3 is a view illustrating a structure of the dishwasher according to one embodiment.

Referring to FIG. 3, the sump 50, the circulation pump 51, the distribution valve assembly 200, the fixed nozzle assembly 300 and the rotary spray nozzles 61 and 63 are involved in circulating and spraying washing water.

The washing water sprayed by the fixed nozzle assembly 300 or the rotary spray nozzles 61 and 63 is accommodated in the sump 50, and the washing water accommodated in the sump 50 is pumped to the distribution valve assembly 200 by the circulation pump 51.

The distribution valve assembly 200 distributes the washing water pumped by the circulation pump 51 to the rotary spray nozzles 61 and 63, the left fixed nozzle 330, and the right fixed nozzle 340.

In addition, the distribution valve assembly 200 may be operated in a plurality of distribution modes for distributing washing water. For example, the distribution valve assembly 200 may be operated in first, second, third, and fourth distribution modes, and in the first distribution mode, the distribution valve assembly 200 may distribute washing water only to the rotary spray nozzles 61 and 63 through a second hose 271*b*. In the second distribution mode, the distribution valve assembly 200 may distribute washing water only to the right fixed nozzle 340 through a third hose 271*c*. In the third distribution mode, the distribution valve assembly 200 may distribute washing water only to the left and right fixed nozzles 330 and 340 through a first hose 271*a* and the third hose 271*c*. In the fourth distribution mode, the distribution valve assembly 200 may distribute washing water only to the left fixed nozzle 330 through the first hose 271*a*.

Washing water distributed to the rotary spray nozzles 61 and 63 is sprayed toward dishes by the rotary spray nozzles 61 and 63 to wash the dishes. In addition, washing water distributed to the left and right fixed nozzles 330 and 340 is sprayed toward the vane assembly 400 by the left and right fixed nozzles 330 and 340 and is reflected by the vane assembly 400 to washes the dishes.

The washing water that washed the dishes is accommodated in the sump 50 again.

Such washing water circulates through the sump 50, the circulation pump 51, the distribution valve assembly 200, the rotary spray nozzles 61 and 63, and the fixed nozzle assembly 300.

Figure 4:
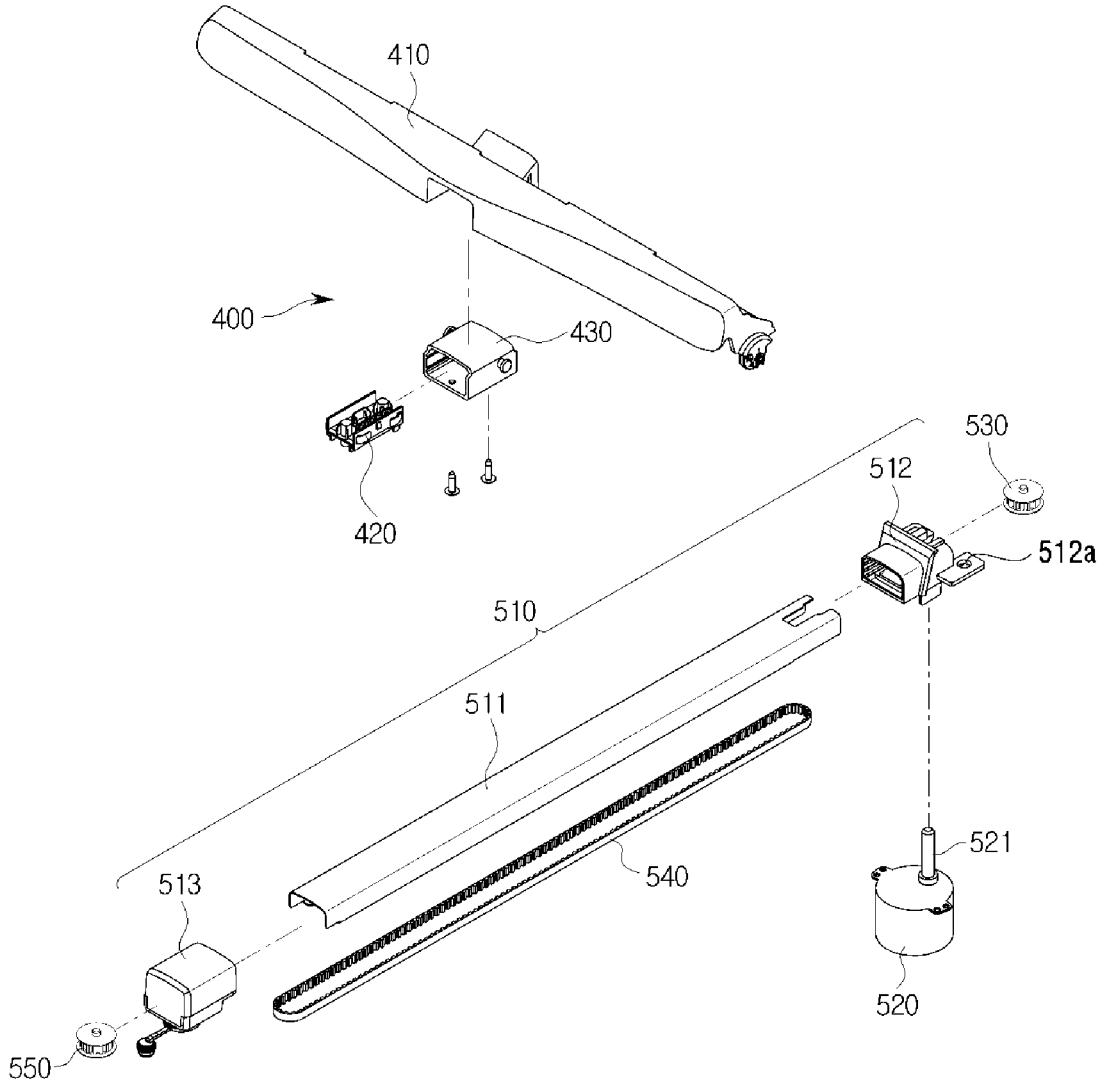
FIG. 4 is a view illustrating a configuration of a vane assembly and a vane driving assembly included in the dishwasher according to one embodiment.
Figure 5:
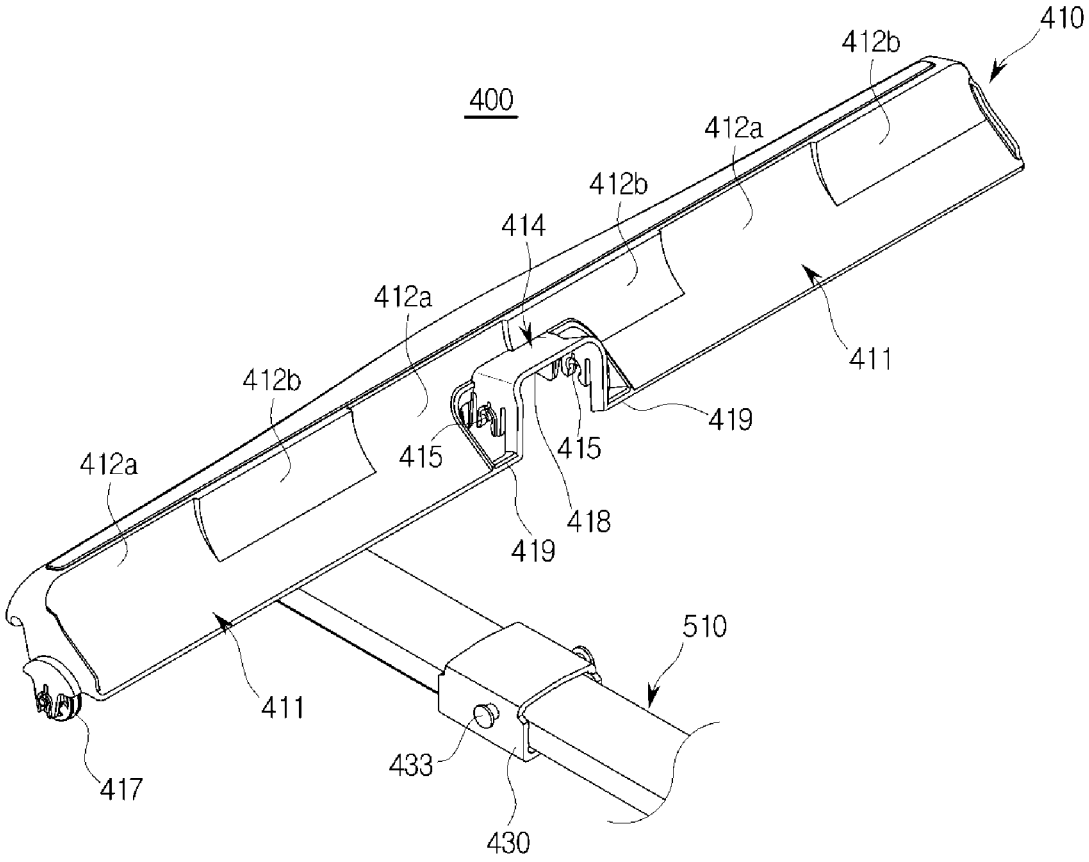
FIG. 5 is a view illustrating the configuration of the vane assembly included in the dishwasher according to one embodiment.
Figure 6:
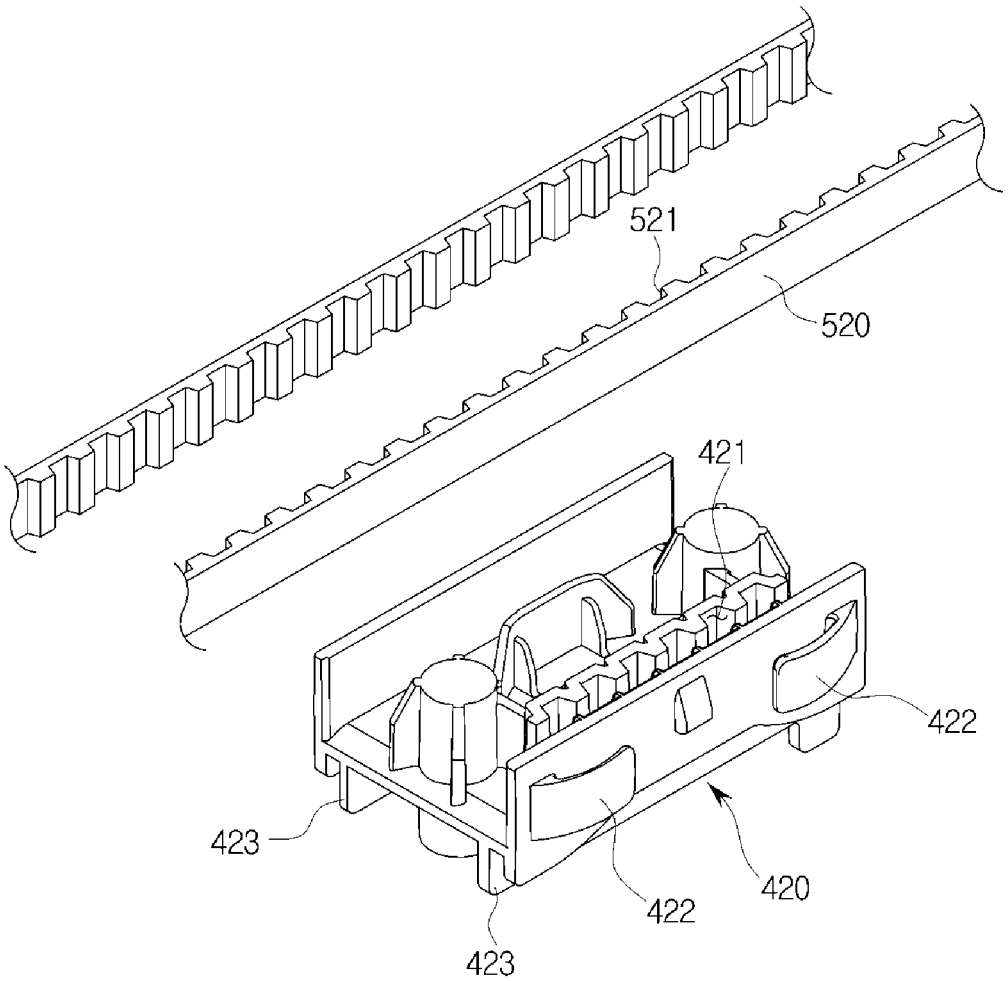
FIG. 6 is a view illustrating a configuration of a belt and a belt holder included in the dishwasher according to one embodiment.

FIG. 4 is a view illustrating a configuration of a vane assembly and a vane driving assembly included in the dishwasher according to one embodiment, FIG. 5 is a view illustrating the configuration of the vane assembly included in the dishwasher according to one embodiment, and FIG. 6 is a view illustrating a configuration of a belt and a belt holder included in the dishwasher according to one embodiment.

Referring to FIGS. 4 to 6, the dishwasher includes the vane assembly 400 that reflects washing water sprayed by the fixed nozzle assembly 300 and the vane driving assembly 500 that linearly moves the vane assembly 400 forward and backward.

The vane driving assembly 500 includes a vane guide 510 that guides the movement of the vane assembly 400, a vane driving motor 520 that generates a rotational force for moving the vane assembly 400, a drive pulley 530 coupled to a drive shaft 521 of the vane driving motor 520 to rotate, a belt 540 that is connected to the drive pulley 530, rotates, and is disposed at an inner space of the vane guide 510, and a driven pulley 550 connected to the belt 540 to rotatably support the belt 540.

The vane guide 510 may be provided lengthily extending in forward and backward directions at a central portion between the left and right walls 33 and 34 of the tub 30.

The vane guide 510 includes a guide rail 511 in a tubular shape in which an inner space and an open lower portion are formed, a rear holder 512 that rotatably supports the drive pulley 530 and is coupled to a rear end portion of the guide rail 511, and a front holder 513 that rotatably supports the driven pulley 550 and is coupled to a front end portion of the guide rail 511.

The guide rail 511 is provided lengthily extending in forward and backward directions at the central portion between the left and right walls 33 and 34 of the tub 30, and the inner space and the lower opening of the guide rail 511 may extend from one end portion to the other end portion in a lengthwise direction of the vane guide 510.

A coupling hole 512*a* that is formed to couple the vane guide 510 to a bottom plate cover 600 (see FIG. 7) that will be described below may be formed at the rear holder 512.

The belt 540 is disposed at the inner space formed in the guide rail 511, and forms a closed curve by being wound around the drive pulley 530 and the driven pulley 550. In addition, when the vane driving motor 520 is driven, the belt 540 may rotate in a rotation direction of the vane driving motor 520.

Such a belt 540 may be formed of a resin material including aramid fibers in consideration of tensile strength, cost, and the like.

Teeth 541 that transmit a driving force of the belt 540 may be formed at an inner side surface of the belt 540, and the teeth 541 of the belt 540 may transmit the driving force to the vane assembly 400.

The vane assembly 400 includes the vane 410 that reflects washing water sprayed by the fixed nozzle assembly 300, a belt holder 420 that receives the driving force from the belt 540, and a vane holder 430 coupled to the belt holder 420 and the vane 410.

The vane 410 may be provided lengthily extending in a direction perpendicular to the vane guide 510.

The vane 410 may include a reflector 411 that reflects washing water sprayed by the fixed nozzle assembly 300, a cap 414 provided at a central portion of the reflector 411 in a lengthwise direction thereof, a roller 417 with which the vane 410 moves smoothly, and a rotation hook 419 provided to interfere with a rotation guide 610 of the bottom plate cover 600 that will be described below.

The reflector 411 includes reflective surfaces 412*a* and 412*b* obliquely provided to reflect washing water. The reflective surfaces 412*a* and 412*b* may include the first reflective surface 412*a* and the second reflective surface 412*b* that have inclinations different from each other and are alternately arranged in a lengthwise direction so that reflection angles of washing water are different from each other.

The cap 414 may include a coupling groove 415 for being coupled to the vane holder 430, and a rotation stopper 418 that limits a rotational range of the vane 410 when the vane 410 that will be described below is rotated by the rotation guide 610 (see FIG. 7) of the bottom plate cover 600 (see FIG. 7).

A coupling protrusion 433 of the vane holder 430 may be coupled to the coupling groove 415 of the cap 414. Specifically, the coupling protrusion 433 may be inserted into the coupling groove 415 of the vane 400. The coupling protrusion 433 may rotatably support the vane 410.

The belt holder 420 may be disposed in an inner space 441 of the guide rail 511 similar to the belt 540, and may be coupled to the teeth 541 of the belt 540 to move with the belt 540. To this end, the belt holder 420 may include a teeth coupling portion 421 coupled to the teeth 541 of the belt holder 420.

In addition, the belt holder 420 may include legs 422 and 423 that are supported by the guide rail 511. The legs 422 and 423 may be side legs 422 that protrude in a side direction and are supported by a side wall of the guide rail 511 and lower legs 423 that protrude downward and are supported by a lower wall of the guide rail 511.

The vane holder 430 is coupled to the belt holder 420, moves with the belt holder 420, and transmits a driving force of the belt holder 420 to the vane 410. The vane holder 430 is provided to cover an outer surface of the guide rail 511.

The vane holder 430 may be coupled to the vane holder 420 through the lower opening of the guide rail 511, and the coupling protrusion 433 to which the vane 410 is detachably coupled may be formed at the vane holder 430.

Figure 7:
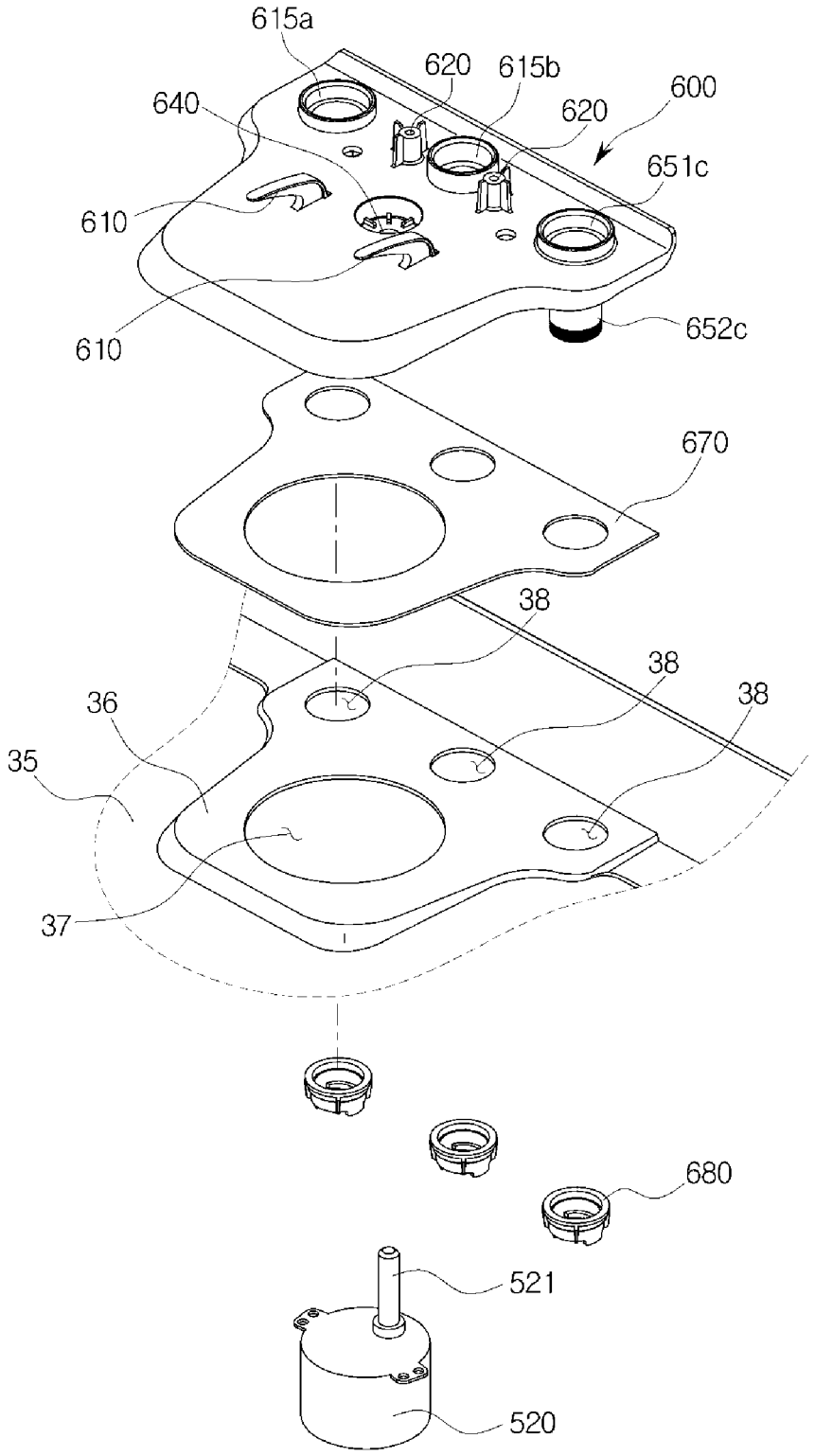
FIG. 7 is a view illustrating a configuration of a bottom plate cover of the dishwasher according to one embodiment.
Figure 8:
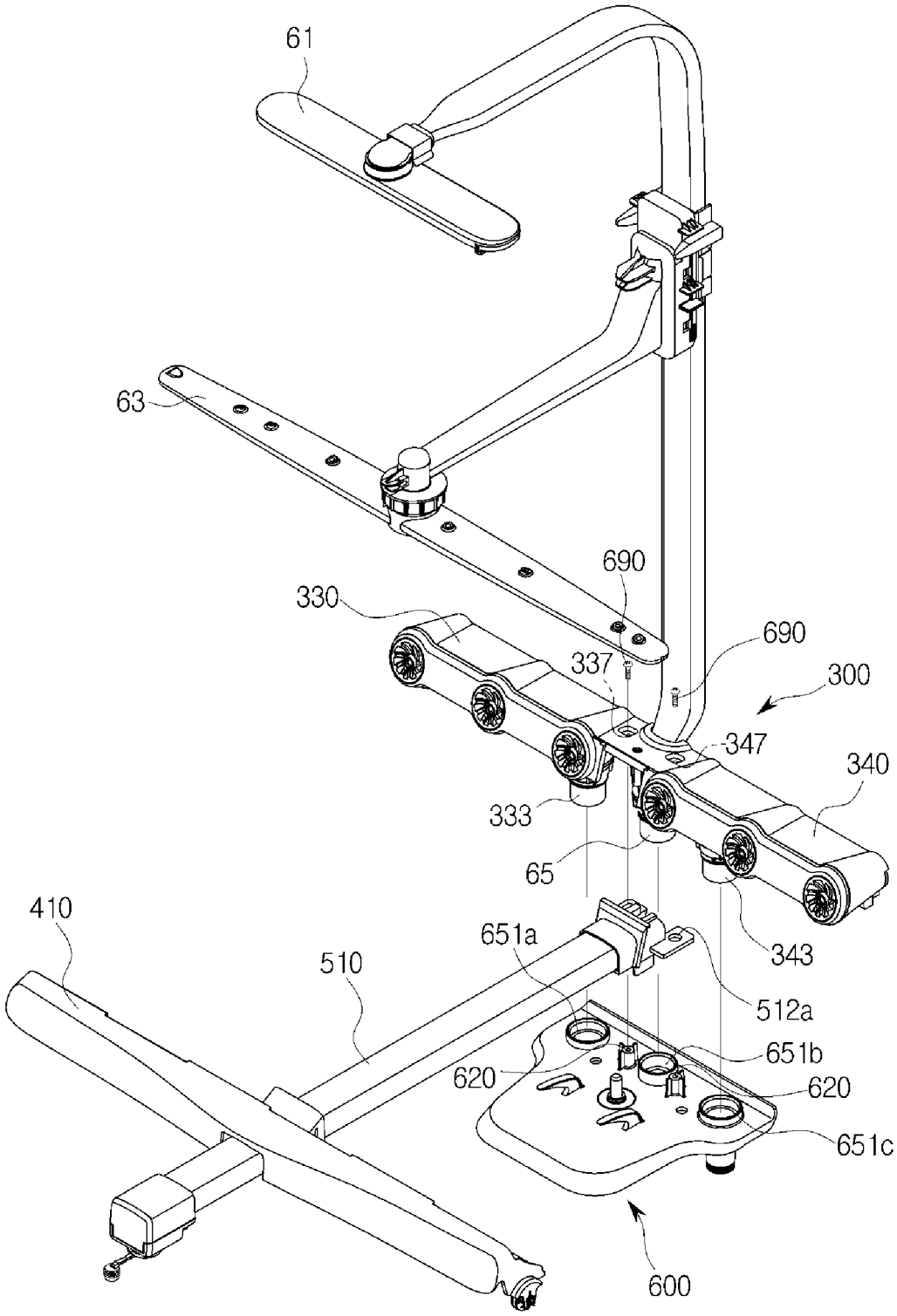
FIG. 8 is a view illustrating a vane guide and a fixed nozzle assembly fixed to the bottom plate cover included in the dishwasher according to one embodiment.

FIG. 7 is a view illustrating a configuration of a bottom plate cover of the dishwasher according to one embodiment, and FIG. 8 is a view illustrating a vane guide and a fixed nozzle assembly fixed to the bottom plate cover included in the dishwasher according to one embodiment.

As illustrated in FIG. 7, the bottom plate cover 600 is provided to couple to one rear side of the bottom plate 35 of the tub 30. Such a bottom plate cover 600 seals a driving motor through hole 37 and flow path through holes 38 formed on the bottom plate 35, and performs a function of fixing the vane guide 510 and the fixed nozzle assembly 300 of the dishwasher 1.

A bottom plate protrusion 36 that protrudes so that the bottom plate cover 600 is coupled thereto may be formed at a rear of the bottom plate 35.

The driving motor through hole 37 through which the vane driving motor 520 for driving the vane assembly 400 passes and the flow path through holes 38 through which flow paths that connect the fixed nozzle assembly 300 and the distribution valve assembly 200 pass may be formed on the bottom plate protrusion 36.

The bottom plate cover 600 is pressed against and coupled to a top surface of the bottom plate protrusion 36.

The bottom plate cover 600 includes a shaft through hole 640 through which the drive shaft 521 of the vane driving motor 520 passes, hose connection portions 652*a*, 652*b*, and 652*c* inserted into the flow path through holes 38 of the bottom plate protrusion 36, nozzle inlet hole connection portions 651*a*, 651*b*, and 651*c* that protrude upward to be connected to the inlet holes 65, 333, and 343 of the rotary spray nozzles 61 and 63 and the fixed nozzle assembly 300, coupling holes 620 for fixing the fixed nozzle assembly 300 and the vane guide 510, and the rotation guide 610 protruding to guide rotation of the vane 410.

Fixing caps 680 are coupled to the hose connection portions 652*a*, 652*b*, and 652*c* of the bottom plate cover 600 so that the bottom plate cover 600 may be fixed to the bottom plate protrusion 36.

The shaft through hole 640 of the bottom plate cover 600 guides the drive shaft 521 of the vane driving motor 520 to protrude toward an inside of the tub 30.

A sealing member 670 may be provided between the bottom plate cover 600 and the bottom plate protrusion 36 so that washing water in the tub 30 does not leak through the driving motor through hole 37 and the flow path through holes 38 of the bottom plate protrusion 36.

As illustrated in FIG. 8, the vane guide 510 and the nozzle assembly 300 may be coupled to the bottom plate cover 600. The bottom plate cover 600, the vane guide 510, and the nozzle assembly 300 may be firmly coupled by a coupling member 690. To this end, coupling holes 620, 512, and 347 may be respectively formed on the bottom plate cover 600, the nozzle assembly 300, and the vane guide 510 at corresponding positions thereof.

Figure 9:
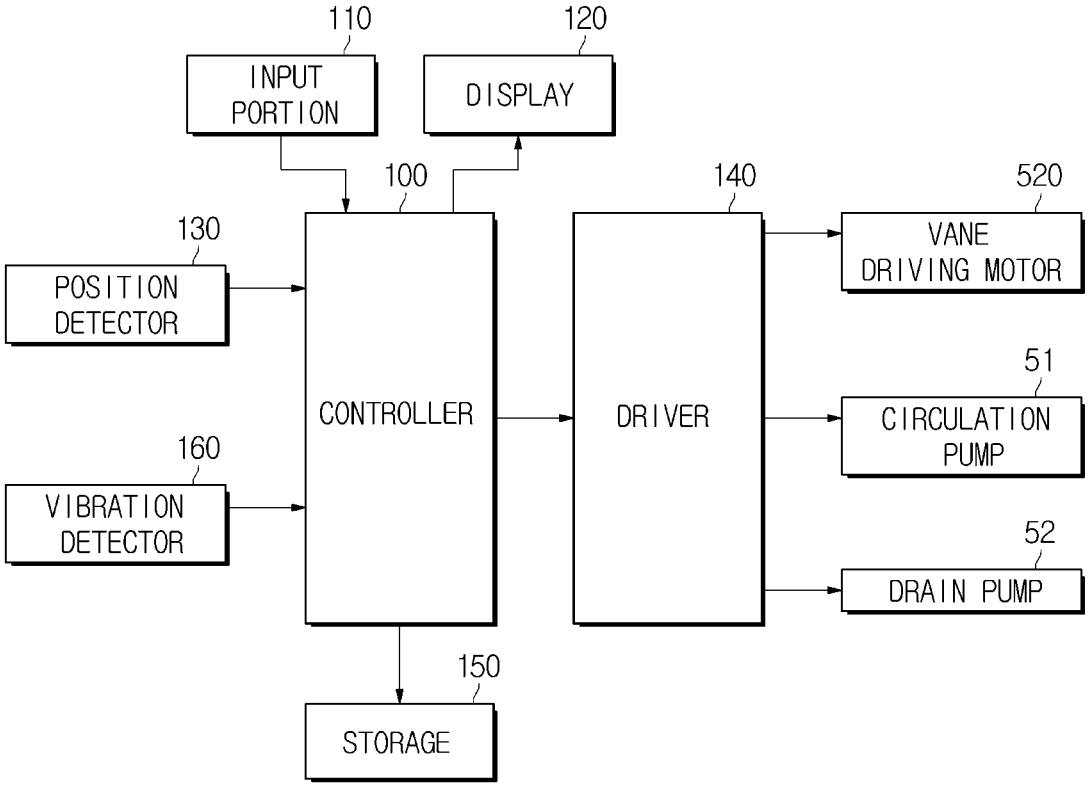
FIG. 9 is a view illustrating a control flowchart of the dishwasher according to one embodiment.
Figure 10:
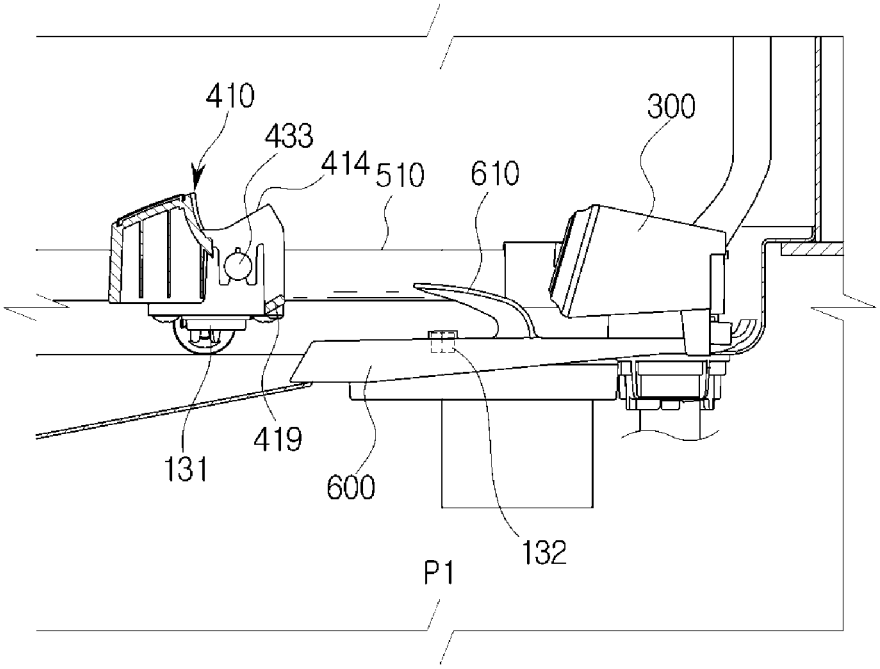
FIG. 10 is a view illustrating one example of a position detector included in the dishwasher according to one embodiment.

FIG. 9 is a view illustrating a control flowchart of the dishwasher according to one embodiment, and FIG. 10 is a view illustrating one example of a position detector included in the dishwasher according to one embodiment.

Referring to FIG. 9, the dishwasher 1 may include an input portion 110, a display 120, a driver 140, the vane driving motor 520, the circulation pump 51, the drain pump 52, a storage 150, and a controller 100. In addition, the dishwasher 1 may further optionally include a position detector 130.

The input portion 110 may include an input button that receives control commands of a user to the dishwasher 1. Such an input button may adopt a micro switch, a membrane switch, a touch pad, or the like.

The display 120 may include a display panel that displays operation information of the dishwasher 1. The display panel may adopt a liquid crystal display (LCD) panel, a light emitting diode (LED) panel, or an organic light emitting diode (OLED) panel.

The driver 140 drives each component included in the dishwasher 1 according to control commands of the controller 100. Specifically, The driver 140 may include a motor driving circuit (not shown) that drives the vane driving motor 520, a pump driving circuit (not shown) that drives the circulation pump 51, and a pump driving circuit (not shown) that drives the drain pump 52.

The vane driving motor 520 generates a rotational force for moving the vane assembly 400. Such a vane driving motor 520 may adopt a direct current (DC) motor, an alternating current (AC) motor, or a stepping motor capable of rotating in both directions of the clockwise and counterclockwise directions. However, the vane driving motor 520 is not limited thereto, and may adopt any motor capable of rotating in both directions or a single direction.

The storage 150 may not only include nonvolatile memories (not shown) such as a magnetic disc and a solid state disk that store programs and data for controlling an operation of the dishwasher 1, and volatile memories (not shown) such as a dynamic random access memory (D-RAM), but also a static random success memory (S-RAM) that temporarily stores temporary data generated when the operation of the dishwasher 1 is controlled.

The controller 100 controls operations of components included in the dishwasher 1. Specifically, the controller 100 outputs control signals to control the vane driving motor 520, the circulation pump 51, and the drain pump 52 on the basis of the control commands input through the input portion 110.

In addition, the dishwasher 1 may optionally include a vibration detector 170 that detects vibrations of the door 11 (see FIG. 1).

The vibration detector 170 may include a vibration sensor (not shown) provided at one side or a central portion of the door 11 (see FIG. 1) to detect vibrations generated when washing water strikes the door 11 (see FIG. 1).

In addition, the dishwasher 1 may optionally include the position detector 130 that detects a position of the vane assembly 400 (see FIG. 1).

As illustrated in FIG. 10, the position detector 130 may include a position identification member 131 attached to the vane assembly 400 and a detection sensor 132 that detects the position identification member 131.

When the position detection sensor 132 detects the position identification member 131, the position detector may 130 determine that the vane assembly 400 is positioned at a position of the position detection sensor 132.

For example, as illustrated in FIG. 10, when the position detection sensor 132 is positioned at a first position P1 adjacent to the fixed nozzle assembly 300, and the position detection sensor 132 detects the position identification member 131, the position detector 130 may determine that the vane assembly 400 is positioned at the first position P1.

The position identification member 131 and the position detection sensor 132 may adopt a permanent magnet and a hall sensor. That is, the hall sensor that detects a magnetic field may detect a position of the vane assembly 400 by detecting a magnetic field of the permanent magnet.

In addition, the position identification member 131 and the position detection sensor 132 may include a protrusion protruding from the vane assembly 400, a micro switch pressed by the protrusion, an infrared light source that emits infrared light, and an infrared light sensor that detects the infrared light.

Although the position identification member 131 and the position detection sensor 132 are illustrated in FIG. 10, the position detector 130 may include only the position detection sensor 132. For example, the position detection sensor 132 may adopt a capacitive proximity sensor that detects a change in electrostatic capacitance due to the vane assembly 400, a ultrasonic wave sensor module that emits an ultrasonic wave and receives an ultrasonic wave reflected by the vane assembly 400, and an infrared light sensor module that emits infrared light and receives infrared light reflected by the vane assembly 400.

Such a position detector 130 is just an optional component, and the dishwasher 1 may not include the position detector 130.

Hereinafter an operation of the dishwasher 1, and more particularly, an operation of the vane assembly 400 (see FIG. 1), will be described.

First, an overall operation of the dishwasher 1 will be described.

The dishwasher 1 may perform water supplying, washing, water draining, and drying processes.

In the water supplying process, washing water may be supplied to an inside of the tub 30 through a water supply pipe (not shown). The washing water supplied to the tub 30 may flow toward and be stored in the sump 50 provided at the lower portion of the tub 30 due to a gradient of the bottom plate 35 of the tub 30.

In the washing process, the circulation pump 51 may be operated to pump the washing water in the sump 50. The washing water pumped by the circulation pump 51 may be distributed to the rotary spray nozzles 61 and 63, the left fixed nozzle 330, and the right fixed nozzle 340 through the distribution valve assembly 200.

The washing water sprayed by the rotary spray nozzles 61 and 63, the left fixed nozzle 330, and the right fixed nozzle 340 may strike dishes to remove scraps and fall with the scraps to be stored again in the sump 50. The circulation pump 51 pumps and recirculates the washing water stored in the sump 50. In the washing process, the circulation pump 51 may repeat operating and stopping several times. During this process, the scraps which fell into the sump 50 with the washing water are collected by a filter installed in the sump 50 and remain in the sump 50 not to circulate into the spray nozzles 61, 63, and 300.

In the water draining process, the drain pump 52 may be operated to drain the scraps and the washing water that remain in the sump 50 to the outside of the main body 10.

In the drying process, a heater (not shown) installed in the tub 30 may be operated to dry the dishes.

Next, forward and backward movements of the vane assembly 400 will described.

Figure 11:
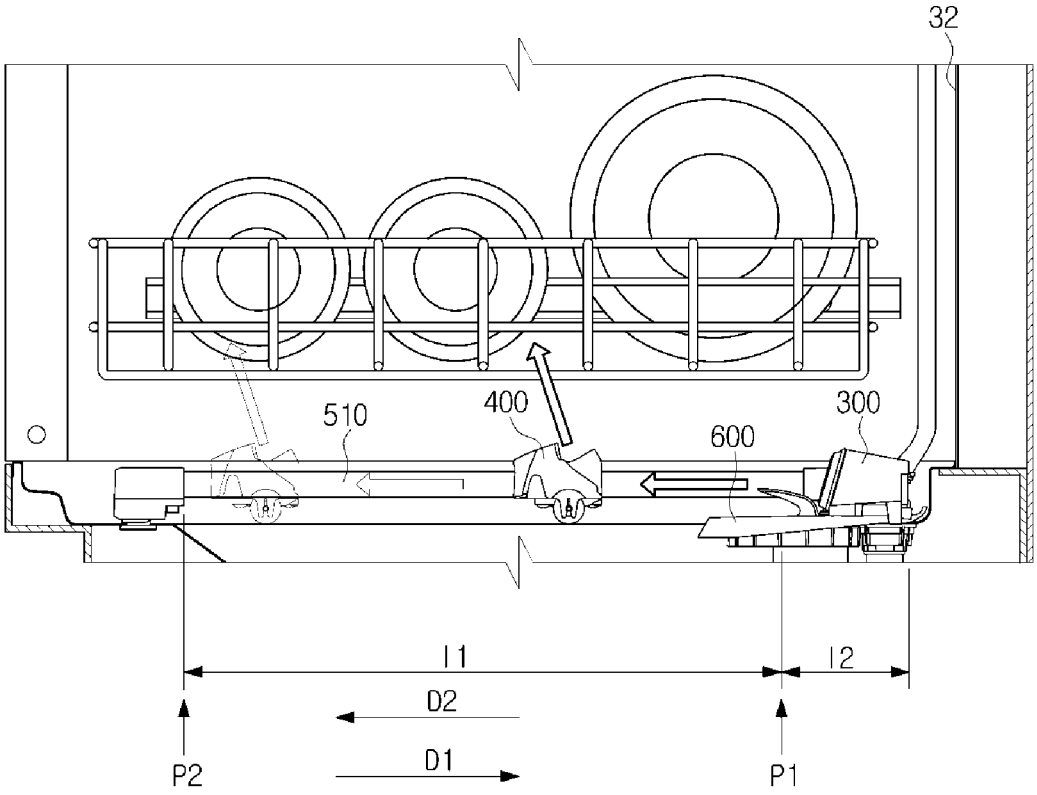
FIGS. 11 and 12 are views illustrating movements of the vane assembly included in the dishwasher according to one embodiment.
Figure 12:
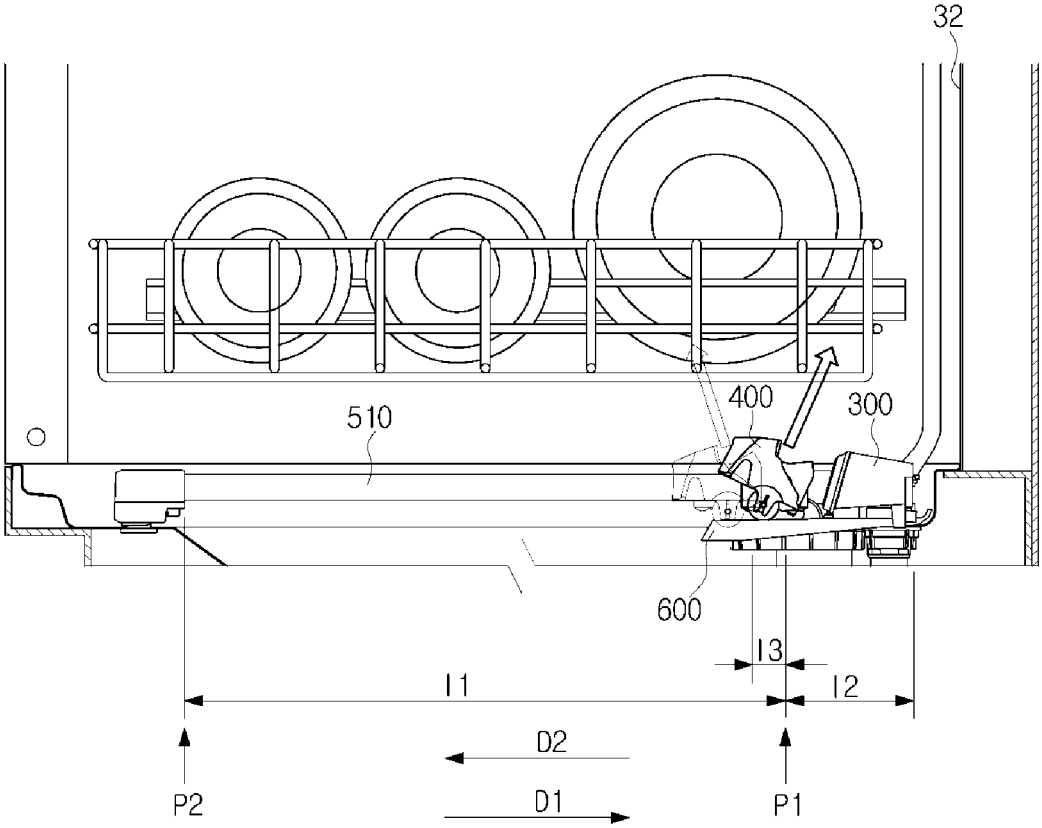

FIGS. 11 and 12 are views illustrating movements of the vane assembly included in the dishwasher according to one embodiment.

Referring to FIGS. 11 and 12, the fixed nozzle assembly 300 is provided at one side of the tub 30, and the vane guide 510 is provided extending from one side toward the other side of the tub 30 in which the fixed nozzle assembly 300 is provided.

In addition, an inside of the tub 30 may be divided into a vane movement section 11 in which the vane assembly 400 may move and a vane no-movement section 12 in which the vane assembly 400 may not move due to the fixed nozzle assembly 300.

When both ends of the vane movement section 11 are referred to as a first position P1 and a second position P2, the vane assembly 400 may move forward and backward between the first position P1 provided at a side of the fixed nozzle assembly 300 and the second position P2 provided at a side opposite the fixed nozzle assembly 300.

In other words, as illustrated in FIG. 10, the vane assembly 400 may move from the first position P1 to the second position P2 along the vane guide 510, and move again from the second position P2 to the first position P1 along the vane guide 510.

In addition, when the vane assembly 400 approaches the first position P1 to wash dishes accommodated in the vane no-movement section 12 where the vane assembly 400 does not move, the vane 410 included in the vane assembly 400 rotates.

Accordingly, as the vane rotates near the first position P1 where the fixed nozzle assembly 300 is positioned, the vane assembly 400 may reflect washing water sprayed by the fixed nozzle assembly 300 toward the dishes accommodated in the vane no-movement section 12.

Rotation of the vane 410 in a vane rotation section 13 will be described in detail below.

Figure 13:
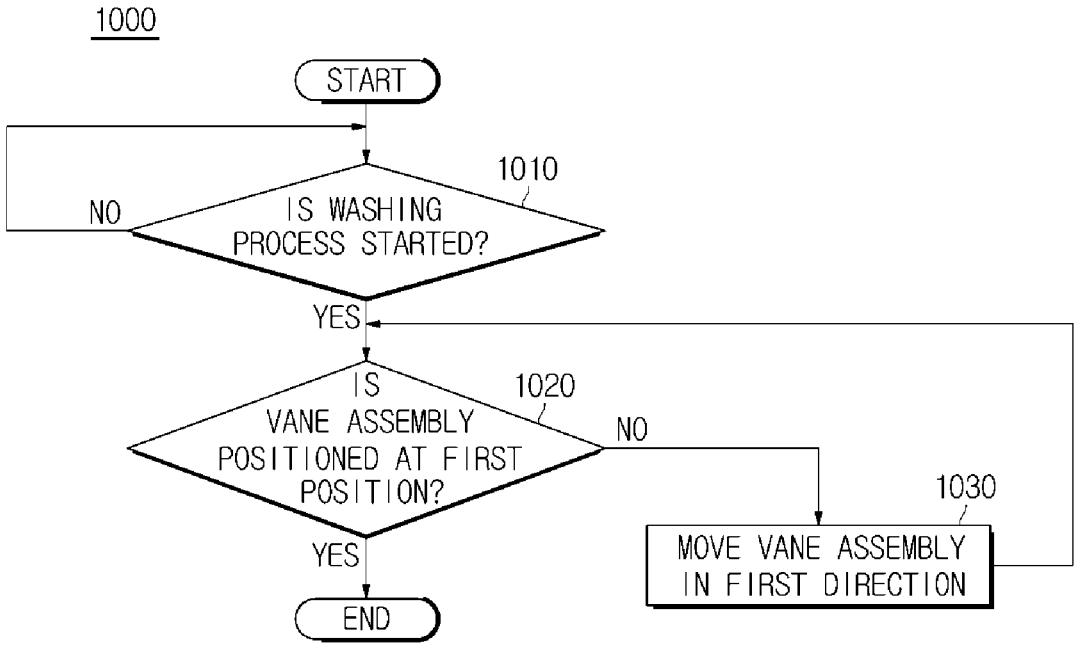
FIG. 13 is a view illustrating a vane initialization method according to one embodiment.

FIG. 13 is a view illustrating a vane initialization method according to one embodiment.

When the washing process of the dishwasher 1 is started, pressure of washing water sprayed by the fixed nozzle assembly 300 may not be immediately raised. Accordingly, when the washing process is started and the vane assembly 400 is positioned far away from the fixed nozzle assembly 300, there is a concern that the washing water sprayed by the fixed nozzle assembly 300 may directly strike the bottom plate 35 of the tub 30.

To prevent this, the dishwasher 1 may position the vane assembly 400 at the first position P1 through a vane initialization method 1000.

The vane initialization method 1000 will be described in detail with reference to FIGS. 11, 12, and 13.

First, the dishwasher 1 determines whether the washing process is started (1010). This is for positioning the vane assembly 400 at the first position P1 before the vane assembly 400 moves forward and backward between the first position P1 and the second position P2.

When the washing process is started (YES in 1010), the dishwasher 1 determines whether the vane assembly 400 is positioned at the first position P1 (1020).

Specifically, the dishwasher 1 may determine whether the vane assembly 400 is positioned at the first position P1 according to whether the position detection sensor 132 (see FIG. 10) positioned at the first position P1 detects the position identification member 131 (see FIG. 10).

In other words, when the position detection sensor 132 (see FIG. 10) detects the position identification member 131 (see FIG. 10), the dishwasher 1 may determine that the vane assembly 400 is positioned at the first position P1.

When the vane assembly 400 is not positioned at the first position P1 (NO in 1020), the dishwasher 1 moves the vane assembly 400 in a first direction D1 (1030). The first direction D1 refers to a direction from any position toward the first position P1.

Specifically, to move the vane assembly 400 in the first direction D1, the dishwasher 1 may rotate the driving motor 520 (see FIG. 4) in a first rotation direction.

When the vane assembly 400 is positioned at the first position P1 (YES in 1020), the dishwasher 1 ends the vane initialization method 1000.

The vane initialization method 1000 illustrated in FIG. 13 is performed when the washing process is started, but is not limited thereto. The vane initialization method that positions the vane at the first position P1 may also be performed in the water supplying process before the washing process.

In addition, although the vane initialization method 1000 in which the dishwasher 1 includes the position detector 130 is illustrated in FIG. 13, the method is not limited thereto.

For example, to position the vane assembly 400 at the first position P1, the dishwasher 1 may move the vane assembly 400 in the first direction D1 for a predetermined time, and may determine that the vane assembly 400 is positioned at the first position P1 when the predetermined time is elapsed.

As the dishwasher 1 performs such a vane initialization method 1000 in the washing process or the water supplying process, the dishwasher 1 may prevent the washing water sprayed by the fixed nozzle assembly 300 from directly striking the bottom plate 35 of the tub 30, and may prevent noise and vibrations generated therefrom.

To help understanding, a movement operation of the vane assembly 400 described below will be assumed that the vane assembly 400 starts the movement operation from the first position P1.

Figure 14:
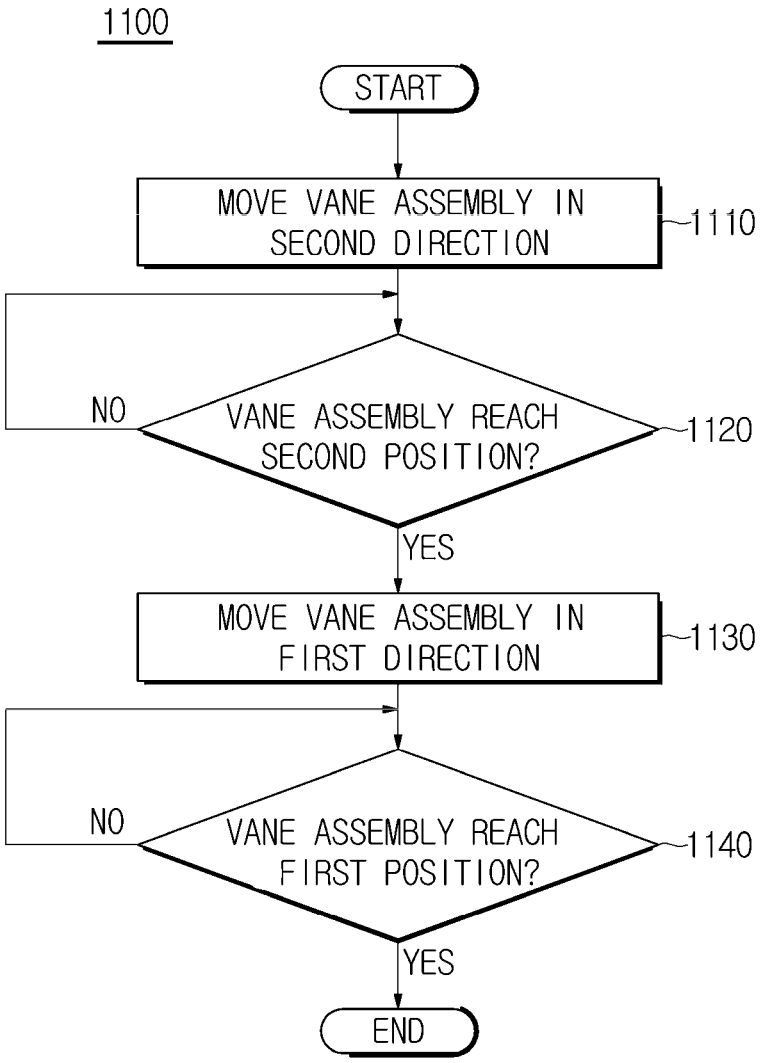
FIG. 14 is a view illustrating a vane movement method according to one embodiment.

FIG. 14 is a view illustrating a vane movement method according to one embodiment.

One example of a vane movement method 1100 will be described with reference to FIGS. 11, 12, and 14.

First, the dishwasher 1 moves the vane assembly 400 in a second direction D2 (1110). The second direction D2 refers to a direction from any position of the vane guide 510 toward the second position P2.

Specifically, to move the vane assembly 400 in the second direction D2, the dishwasher 1 may operate the vane driving motor 520 (see FIG. 4) in a second rotation direction.

Then, the dishwasher 1 determines whether the vane assembly 400 reaches the second position P2 (1120). The second position P2 refers to one end of the vane movement section 11 (see FIG. 13) in which the vane assembly 400 moves. For example, as illustrated in FIG. 13, the second position P2 may be one end of a side opposite the fixed nozzle assembly 300 of both ends of the vane guide 510.

The dishwasher 1 may determine whether the vane assembly 400 reaches the second position P2 through various methods.

For example, the dishwasher 1 may determine whether the vane assembly 400 reaches the second position P2 on the basis of an operation time of the vane driving motor 520 (see FIG. 4).

By dividing a distance between the first and second positions P1 and P2 (hereinafter, referred to as a first reference distance) by a movement speed of the vane assembly 400, a time (hereinafter, referred to as a first reference time) for which the vane assembly 400 moves the first reference distance may be calculated. Here, the movement speed of the vane assembly 400 is calculated on the basis of a rotational speed of the vane driving motor 520 (see FIG. 4) and a radius of the drive pulley 530 (see FIG. 4).

In other words, when the vane driving motor 520 (see FIG. 4) is operated for the first reference time, the vane assembly 400 may move the first reference distance.

The dishwasher 1 may determine whether the vane assembly 400 reaches the second position P2 according to whether a time for which the vane assembly 400 moves in the second direction D2 (a time for which the driving motor is operated in the second rotation direction) is the first reference time or more.

Specifically, when the time for which the vane driving motor 520 (see FIG. 4) is operated in the second rotation direction is the first reference time or more, the dishwasher 1 determines that the vane assembly 400 reaches the second position P2, and when the time for which the vane driving motor 520 (see FIG. 4) is operated in the second rotation direction is less than the first reference time, the dishwasher 1 determines that the vane assembly 400 does not reach the second position P2.

As another example, the dishwasher 1 may determine whether the vane assembly 400 reaches the second position P2 on the basis of rotational displacement of the vane driving motor 520 (see FIG. 4).

When the vane driving motor 520 (see FIG. 4) includes an encoder that detects rotational displacement, the dishwasher 1 may calculate a movement distance of the vane assembly 400 due to an operation of the vane driving motor 520 (see FIG. 4). Specifically, a movement distance of the vane assembly 400 may be calculated on the basis of a product of the rotational displacement of the vane driving motor 520 (see FIG. 4) detected by the encoder and a radius of the drive pulley 530 (see FIG. 4).

The dishwasher 1 may determine whether the vane assembly 400 reaches the second position P2 according to whether the product of the rotational displacement by which the vane driving motor 520 (see FIG. 4) rotates in the second rotation direction and the radius of the drive pulley 530 (see FIG. 4) is the first reference distance or more.

Specifically, when the product of the rotational displacement by which the vane driving motor 520 (see FIG. 4) rotates in the second rotation direction and the radius of the drive pulley 530 (see FIG. 4) is the first reference distance or more, the dishwasher 1 determines that the vane assembly 400 reaches the second position P2. In addition, when the product of the rotational displacement by which the vane driving motor 520 (see FIG. 4) rotates in the second rotation direction and the radius of the drive pulley 530 (see FIG. 4) is less than the first reference distance, the dishwasher 1 determines that the vane assembly 400 does not reach the second position P2.

When the vane assembly 400 reaches the second position P2 (YES in 1120), the dishwasher 1 moves the vane assembly 400 in the first direction D1 (1130). Specifically, to move the vane assembly 400 in the first direction D1, the dishwasher 1 may operate the vane driving motor 520 (see FIG. 4) in the first rotation direction (a rotation direction in which the vane assembly is moved in the first direction D1).

Then, the dishwasher 1 determines whether the vane assembly 400 reaches the first position P1 (1140).

The dishwasher 1 may determine whether the vane assembly 400 reaches the first position P1 through various methods.

For example, the dishwasher 1 may determine whether the vane assembly 400 reaches the first position P1 according to whether a time for which the vane driving motor 520 (see FIG. 4) rotates in the first direction D1 is the first reference time or more.

As another example, the dishwasher 1 may determine whether the vane assembly 400 reaches the first position P1 according to whether a product of a rotational displacement by which the vane driving motor 520 (see FIG. 4) rotates in the first direction D1 and a radius of the drive pulley 530 (see FIG. 4) is the first reference distance or more when the vane driving motor 520 (see FIG. 4) includes an encoder.

As still another example, when the dishwasher 1 includes the position detector 130 (see FIG. 9), the dishwasher 1 may determine whether the vane assembly 400 reaches the first position P1 according to whether the position detection sensor positioned at the first position P1 detects a position identification member attached to the vane assembly 400.

When the vane assembly 400 does not reach the first position P1 (NO in 1140), the dishwasher continuously moves the vane assembly 400 in the first direction D1.

When the vane assembly 400 reaches the first position P1 (YES in 1140), the dishwasher 1 finishes forward and backward movements of the vane assembly 400.

The dishwasher 1 may move the vane assembly 400 forward and backward between the first position P1 and the second position P2 by repeating such a vane movement method 1100.

Figure 15:
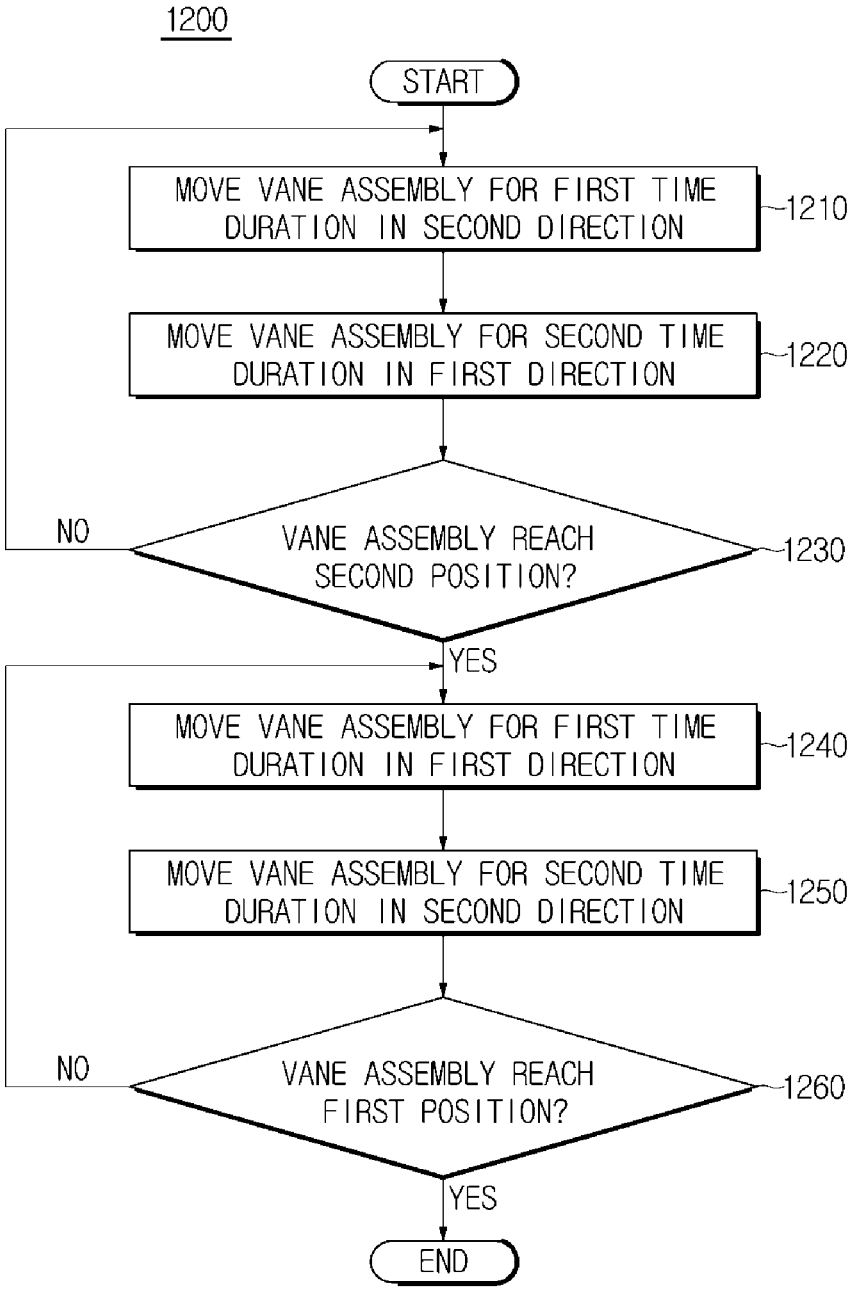
FIG. 15 is a view illustrating a vane movement method according to another embodiment.

FIG. 15 is a view illustrating a vane movement method according to another embodiment.

A vane movement method 1200 illustrated in FIG. 15 includes repeatedly moving in a forward direction (a direction in which the vane assembly finally moves) and a backward direction (a direction opposite to the direction in which the vane assembly 400 finally moves) of the vane assembly 400 while the vane assembly 400 is moving forward and backward between the first position P1 and the second position P2.

For example, when the vane assembly 400 moves from the first position P1 to the second position P2, the dishwasher 1 may repeat the moving of the vane assembly 400 toward the second position P2 in the forward direction for a predetermined time and the moving of the vane assembly toward the first position P1 in the backward direction.

At this point, by a time for which the vane assembly 400 is moved in the forward direction being greater than a time for which the vane is moved in the backward direction, the dishwasher 1 may move the vane assembly 400 in the forward direction. In other words, the dishwasher 1 may repeat the moving of the vane assembly 400 in the forward and backward directions until the vane assembly 400 reaches the second position P2.

The vane movement method 1200 will be described in detail with reference to FIGS. 11, 12, and 15.

First, the dishwasher 1 moves the vane assembly 400 in the second direction D2 for a first time duration (1210). Specifically, the dishwasher 1 may operate the vane driving motor 520 (see FIG. 4) for the first time duration in the second rotation direction.

The first time duration may refer to a time for which the vane assembly 400 moves in the forward direction (here, the second direction D2), and may be differently set according to the first reference time for which the vane assembly 400 moves from the first position P1 to the second position P2. For example, when the first reference time is approximately 11 seconds, the first time duration may be set to approximately 3 seconds.

Then, the dishwasher 1 moves the vane assembly 400 for a second time duration in the first direction D1 (1220). Specifically, the dishwasher 1 may move the vane driving motor 520 (see FIG. 4) for the second time duration in the first rotation direction.

The second time duration may refer to a time for which the vane assembly 400 moves in the backward direction (here, the first direction D1), and may be differently set according to a reference time and the first time duration. For example, when the reference time is 11 seconds and the first time duration is 3 seconds, the second time duration may be set to 1 second. That is, the second time duration may be set to be less than the first time duration.

Then, the dishwasher 1 determines whether the vane assembly 400 reaches the second position P2 (1230).

The dishwasher 1 may determine whether the vane assembly 400 reaches the second position P2 through various methods.

For example, the dishwasher 1 may accumulate time differences between the first time duration and the second time duration, and may determine whether the vane assembly 400 reaches the second position P2 according to whether the accumulated time is the first reference time or more.

Specifically, when the accumulated time is the first reference time or more, the dishwasher 1 determines that the vane assembly 400 reaches the second position P2, and when the accumulated time is less than the first reference time, the dishwasher 1 determines that the vane assembly 400 does not reach the second position P2.

As another example, when the dishwasher 1 includes an encoder attached to the vane driving motor 520 (see FIG. 4), the dishwasher 1 may accumulate distance differences between a first distance that the vane assembly 400 moves in the forward direction and a second distance that the vane assembly 400 moves in the backward direction, and may determine whether the vane assembly 400 reaches the second position P2 according to whether the accumulated distance is the first reference distance or more, which is a distance between the first position P1 and the second position P2.

Specifically, when the accumulated distance is the first reference distance or more, the dishwasher 1 determines that the vane assembly 400 reaches the second position P2, and when the accumulated distance is less than the first reference distance, the dishwasher 1 determines that the vane assembly 400 does not reach the second position P2.

When the vane assembly 400 does not reach the second position (NO in 1230), the dishwasher 1 repeats forward and backward movements of the vane assembly 400.

When the vane assembly 400 reaches the second position P2 (YES in 1230), the dishwasher 1 moves the vane assembly 400 for the first time duration in the first direction D1 (1240). Specifically, the dishwasher 1 may operate the vane driving motor 520 (see FIG. 4) for the first time duration in the first rotation direction.

The first time duration may refer to a time for which the vane assembly 400 moves in the forward direction (here, the first direction D1), and may be different from the first time duration in 1210.

Then, the dishwasher 1 moves the vane assembly 400 for the second time duration in the second direction D2 (1250). Specifically, the dishwasher 1 may operate the vane driving motor 520 (see FIG. 4) for the second time duration in the second rotation direction.

The second time duration may refer to a time for which the vane assembly 400 moves in the backward direction (here, the second direction D2), and may be different from the second time duration in 1220.

Then, the dishwasher 1 determines whether the vane assembly 400 reaches the first position P1 (1260).

The dishwasher 1 may determine whether the vane assembly 400 reaches the first position P1 through various methods.

For example, the dishwasher 1 may accumulate time differences between the first time duration and the second time duration, and may determine whether the vane assembly 400 reaches the second position P2 according to whether the accumulated time is the first reference time or more.

As another example, when the dishwasher 1 includes an encoder attached to the vane driving motor 520 (see FIG. 4), the dishwasher 1 may accumulate distance differences between the first distance that the vane assembly 400 moves in the forward direction and the second distance that the vane assembly 400 moves in the backward direction, and may determine whether the vane assembly 400 reaches the second position P2 according to whether the accumulated distance is the first reference distance or more, which is a distance between the first position P1 and the second position P2.

As still another example, when the dishwasher 1 includes a position identification member attached to the vane assembly 400 and a position detection sensor provided at the first position P1, the dishwasher 1 may determine whether the vane assembly 400 reaches the first position P1 according to whether the position detection sensor provided at the first position P1 detects the position identification member.

When the vane assembly 400 does not reach the first position P1 (NO in 1260), the dishwasher 1 repeats forward and backward movement of the vane assembly 400.

When the vane assembly 400 reaches the first position P1 (YES in 1260), the dishwasher 1 finishes the movement of the vane assembly 400.

In the washing process, the dishwasher 1 may move the vane assembly 400 forward and backward between the first position P1 and the second position P2 by repeating such a vane movement method 1200.

In addition, the washing capability of the dishwasher 1 may be further improved by repeating forward and backward moving of the vane assembly 400 while the vane assembly 400 is moving forward and backward between the first position P1 and the second position P2.

Figure 16:
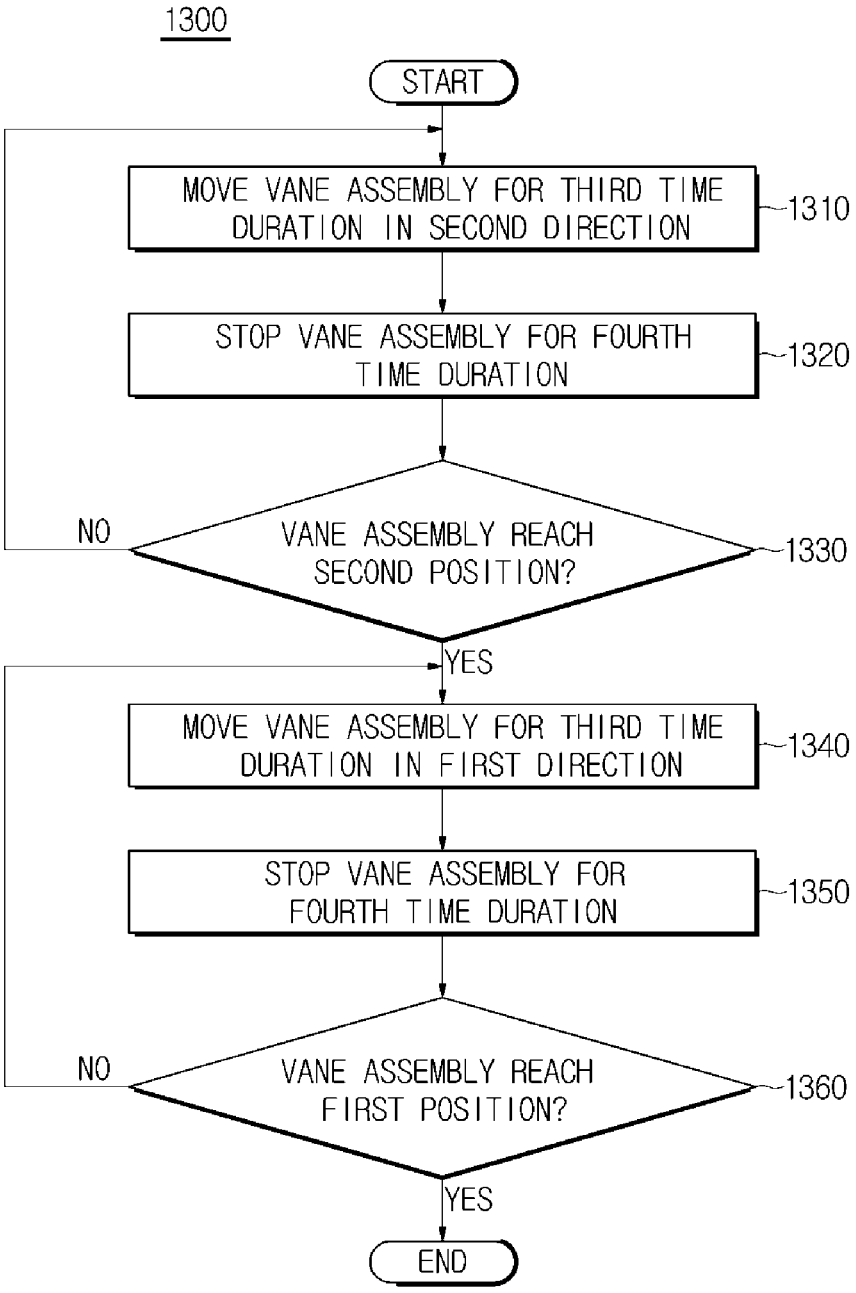
FIG. 16 is a view illustrating a vane movement method according to still another embodiment.

FIG. 16 is a view illustrating a vane movement method according to still another embodiment.

A vane movement method 1300 illustrated in FIG. 16 includes repeating moving and stopping of the vane assembly 400 while the vane assembly 400 is moving forward and backward between the first position P1 and the second position P2.

For example, when the vane assembly 400 moves from the first position P1 to the second position P2, the dishwasher 1 may repeat moving of the vane assembly 400 for a predetermined time toward the second position P2 in the second direction D2 and stopping the vane assembly 400 for a predetermined time. In other words, the dishwasher 1 may repeat moving and stopping of the vane assembly 400 until the vane assembly 400 reaches the second position P2.

The vane movement method 1300 will be described in detail with reference to FIGS. 11, 12, and 16.

First, the dishwasher 1 moves the vane assembly 400 in the second direction D2 for a third time duration (1310). Specifically, the dishwasher 1 may operate the vane driving motor 520 (see FIG. 4) for the third time duration in the second rotation direction.

The third time duration may refer to a time for which the vane assembly 400 moves between the first position P1 and the second position P2, and may be differently set according to the first reference time for which the vane assembly 400 moves between the first position P1 and the second position P2. For example, when the first reference time is approximately 11 seconds, the third time duration may be set to approximately 2 seconds.

Then, the dishwasher 1 stops the vane assembly 400 for a fourth time duration (1320). Specifically, the dishwasher 1 may stop the vane driving motor 520 (see FIG. 4) for the fourth time duration.

The fourth time duration may refer to a time for which the vane assembly 400 stops a movement, and may be differently set according to the first reference time and the third time duration. For example, when the first reference time is 11 seconds and the third time duration is 3 seconds, the fourth time duration may be set to approximately 1 second.

Then, the dishwasher 1 determines whether the vane assembly 400 reaches the second position P2 (1330).

The dishwasher 1 may determine whether the vane assembly 400 reaches the second position P2 through various methods.

For example, the dishwasher 1 may accumulate the third time duration, and may determine whether the vane assembly 400 reaches the second position P2 according to whether the accumulated time is the first reference time or more.

Specifically, when the accumulated time is the first reference time or more, the dishwasher 1 determines that the vane assembly 400 reaches the second position P2, and when the accumulated time is less than the first reference time, the dishwasher 1 determines that the vane assembly 400 does not reach the second position P2.

As another example, the dishwasher 1 may accumulate a distance that the vane assembly 400 moves, and may determine whether the vane assembly 400 reaches the second position P2 according to whether the accumulated distance is the first reference distance or more.

Specifically, when the accumulated distance is the first reference distance or more, the dishwasher 1 determines that the vane assembly 400 reaches the second position P2, and when the accumulated distance is less than the first reference distance, the dishwasher 1 determines that the vane assembly 400 does not reach the second position P2.

When the vane assembly 400 does not reach the second position (NO in 1330), the dishwasher 1 repeats moving and stopping of the vane assembly 400 between the first position P1 and the second position P2.

When the vane assembly 400 reaches the second position P2 (YES in 1330), the dishwasher 1 moves the vane assembly 400 for the third time duration in the first direction D1 (1340). Specifically, the dishwasher 1 may operate the vane driving motor 520 (see FIG. 4) for the third time duration in the first rotation direction.

The third time duration may refer to a time for which the vane assembly 400 moves between the first position P1 and the second position P2, and may be different from the third time duration in 1310.

Then, the dishwasher 1 stops the vane assembly 400 for the fourth time duration (1350). Specifically, the dishwasher 1 may stop the vane driving motor 520 (see FIG. 4) for the fourth time duration.

The fourth time duration may refer to a time for which the vane assembly 400 stops a movement, and may be different from the fourth time duration in 1320.

Then, the dishwasher 1 determines whether the vane assembly 400 reaches the first position P1 (1360).

The dishwasher 1 may determine whether the vane assembly 400 reaches the first position P1 through various methods.

For example, the dishwasher 1 may accumulate the third time duration, and may determine whether the vane assembly 400 reaches the first position P1 according to whether the accumulated time is the first reference time or more.

As another example, when the dishwasher 1 includes an encoder attached to the vane driving motor 520 (see FIG. 4), the dishwasher 1 may accumulate a distance that the vane assembly 400 moves, and may determine whether the vane assembly 400 reaches the first position P1 according to whether the accumulated distance is the first reference distance or more.

As still another example, when the dishwasher 1 includes a position identification member attached to the vane assembly 400 and a position detection sensor provided at the first position P1, the dishwasher 1 may determine whether the vane assembly 400 reaches the first position P1 according to whether the position detection sensor provided at the first position P1 detects the position identification member.

When the vane assembly 400 does not reach the first position P1 (NO in 1360), the dishwasher 1 repeats moving and stopping of the vane assembly 400.

When the vane assembly 400 reaches the first position P1 (YES in 1360), the dishwasher 1 finishes the movement of the vane assembly 400.

In the washing process, the dishwasher 1 may move the vane assembly 400 forward and backward between the first position P1 and the second position P2 by repeating such a vane movement method 1300.

In addition, the washing capability of the dishwasher 1 is further improved by repeating moving and stopping of the vane assembly 400 while the vane assembly 400 is moving forward and backward between the first position P1 and the second position P2.

Figure 17:
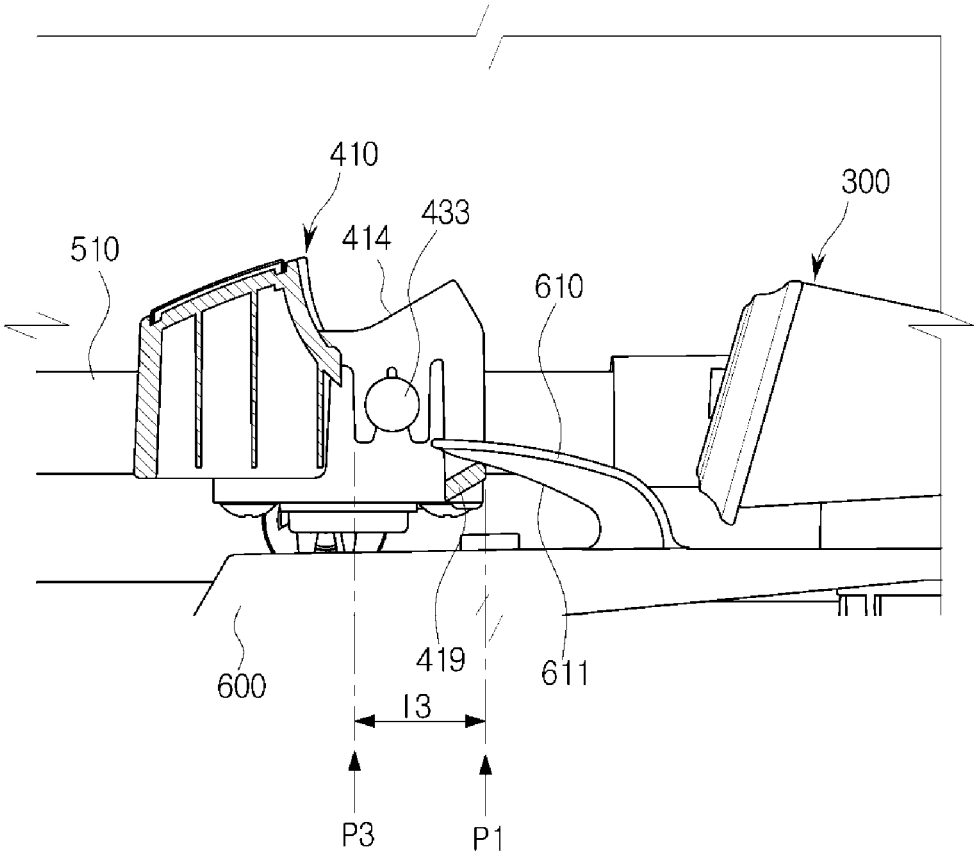
FIGS. 17 and 18 are views illustrating rotational operations of a vane included in the dishwasher according to one embodiment.
Figure 18:
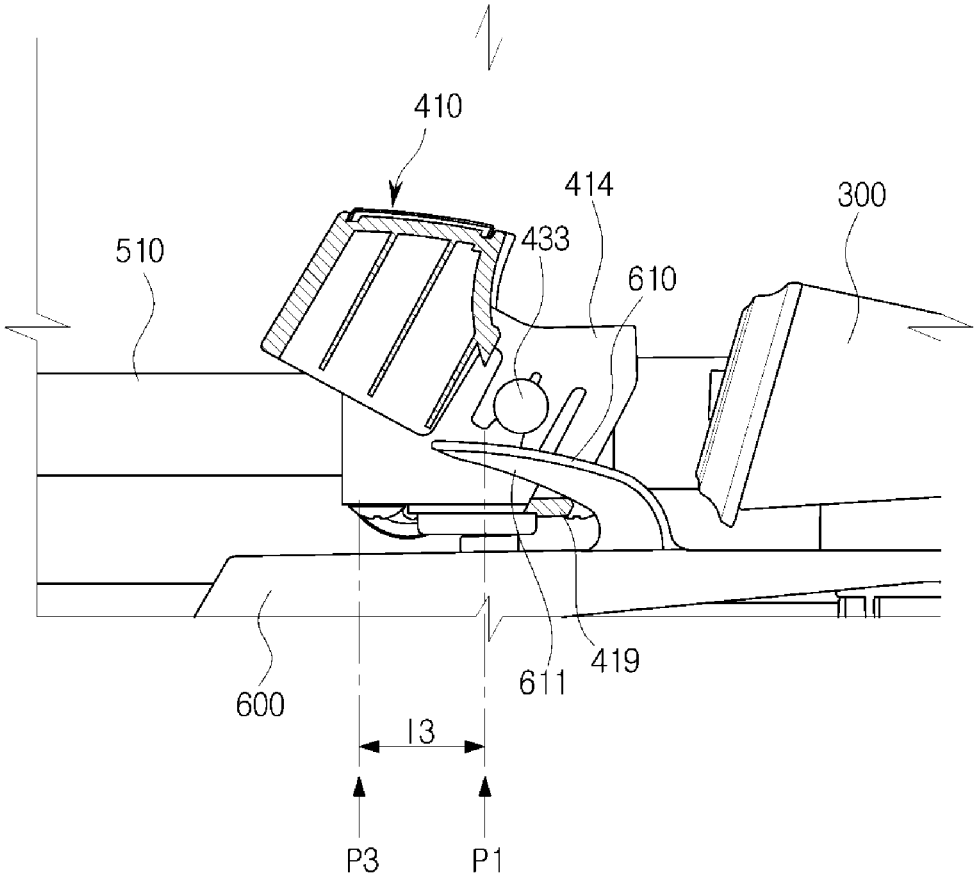

FIGS. 17 and 18 are views illustrating rotational operations of a vane included in the dishwasher according to one embodiment.

Referring to FIGS. 17 and 18, when the vane assembly 400 approaches the first position P1 to wash dishes accommodated in the vane no-movement section 12 where the vane assembly 400 does not move, the vane 410 included in the vane assembly 400 rotates.

A section in which the vane 410 rotates as described above refers to the vane rotation section 13. In addition, a third position P3 refers to a position at which the vane rotation section starts. In other words, the vane 410 rotates while the vane assembly 400 is moving in the vane rotation section 13 between the first position P1 and the third position P3.

The rotation guide 610 protruding to guide the movement of the vane 410 is formed on the bottom plate cover 600, and the rotation hook 419 configured to interfere with the rotation guide 610 is formed at the vane 410. The coupling protrusion 433 formed at the vane holder 430 serves as a rotational shaft of the vane 410.

In addition, the rotation guide 610 includes a guide surface 611 that is in contact with the rotation hook 419 and is formed as a curved surface so that the vane 410 smoothly rotates.

When the vane assembly 400 reaches the third position P3, the vane assembly 400 moves in the first direction D1, and then, the rotation hook 419 of the vane 410 is pressed by the guide surface 611 of the rotation guide 610 of the bottom plate cover 600 as illustrated in FIG. 17.

In addition, as the rotation hook 419 is pressed by the rotation guide 610, the vane 410 rotates about the coupling protrusion 433 of the vane holder 430 as illustrated in FIG. 18. Such a rotation of the vane 410 continues until the cap 414 of the vane 410 is hooked at the vane guide 510.

Figure 19:
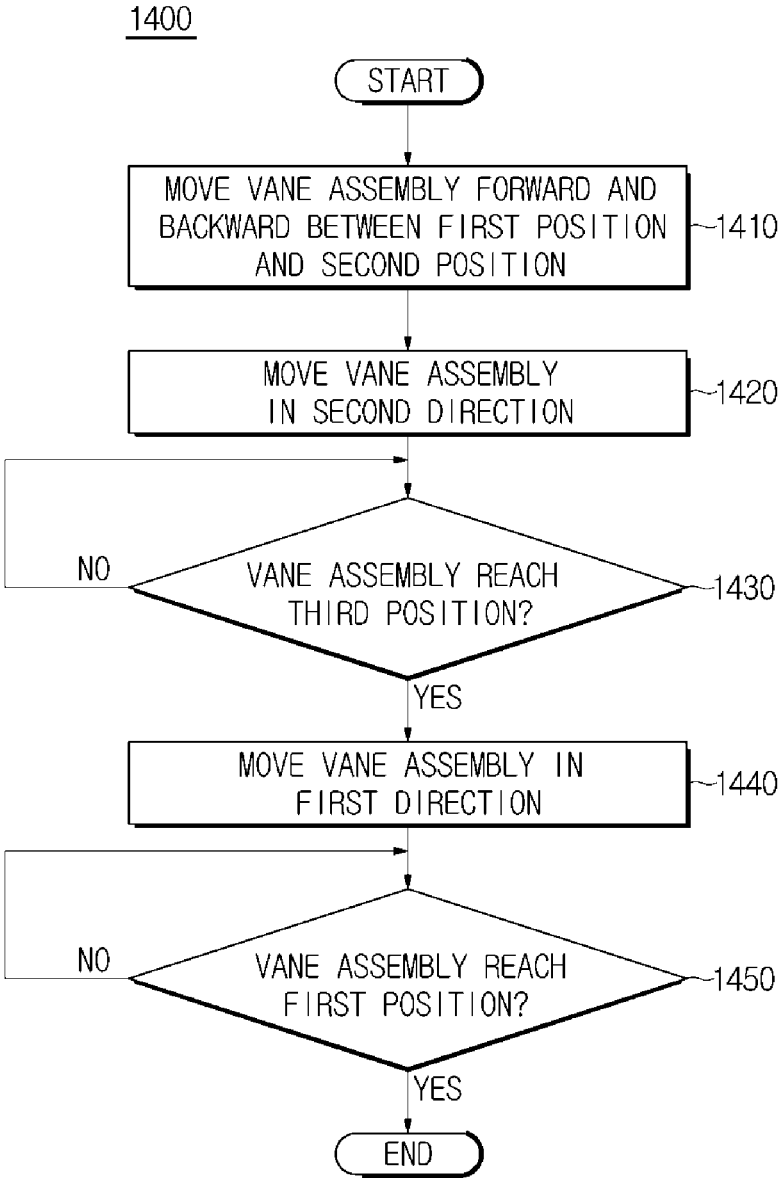
FIG. 19 is a view illustrating a vane movement method according to yet another embodiment.

FIG. 19 is a view illustrating a vane movement method according to yet another embodiment.

Referring to FIG. 13 again, by rotating the vane 410 while the vane assembly 400 is positioned in the vane rotation section 13, dishes accommodated in the vane no-movement section 12 are washed. Accordingly, a time for which dishes positioned in the vane no-movement section 12 are washed is less than a time for which dishes positioned in the vane movement section 11 are washed.

A vane movement method 1400 illustrated in FIG. 19 includes the vane assembly 400 moving forward and backward in the vane movement section 11 (see FIG. 13) and the vane assembly 400 additionally moving forward and backward in the vane rotation section 13 (see FIG. 13) to improve capability of washing dishes positioned in the vane no-movement section 12.

The vane movement method 1400 will be described in detail with reference to FIGS. 17, 18, and 19.

First, the dishwasher 1 moves the vane assembly 400 forward and backward between the first position P1 and the second position P2 (1410).

Here, the forward and backward movements between the first position P1 and the second position P2 may be any one among the vane movement method 1100 illustrated in FIG. 14, the vane movement method 1200 illustrated in FIG. 15, or the vane movement method 1300 illustrated in FIG. 16. In addition, the forward and backward movements between the first position P1 and the second position P2 may also be a vane movement method excluding the vane movement methods 1100, 1200, and 1300 respectively illustrated in FIGS. 14, 15, and 16.

When the vane assembly 400 moves forward and backward between the first position P1 and the second position P2 and reaches the first position P1, the dishwasher 1 moves the vane assembly 400 in the second direction D2 (1420). Specifically, to move the vane assembly 400 in the second direction D2, the dishwasher 1 may operate the vane driving motor 520 (see FIG. 4) in the second rotation direction.

Then, the dishwasher 1 determines whether the vane assembly 400 reaches the third position P3 (1430). Here, the third position P3 refers to a position at which the vane rotation section 13 starts as described above.

The dishwasher 1 may determine whether the vane assembly 400 reaches the third position P3 through various methods.

For example, the dishwasher 1 may determine whether the vane assembly 400 reaches the third position P3 according to whether a time for which the vane driving motor 520 rotates in the second rotation direction is equal to or greater than a time for which the vane assembly 400 moves between the first position P1 and the third position P3 (hereinafter, referred to as a second reference time).

Specifically, when the time for which the vane driving motor 520 is rotated in the second rotation direction is the second reference time or more, the dishwasher 1 determines that the vane assembly 400 reaches the third position P3, and when the time for which the vane driving motor 520 is rotated in the second rotation direction is less than the second reference time, the dishwasher determines that the vane assembly 400 does not reach the third position P3.

As another example, when the vane driving motor 520 (see FIG. 4) includes an encoder that detects rotational displacement, whether the vane assembly 400 reaches the third position P3 may be determined according to whether a product of a rotational displacement by which the vane driving motor 520 (see FIG. 4) rotates in the second rotation direction and the radius of the drive pulley 530 (see FIG. 4) is equal to or greater than a distance between the first position P1 and the third position P3 (hereinafter, referred to as a second reference distance).

Specifically, when the product of the rotational displacement by which the vane assembly 400 rotates in the second rotation direction and the radius of the drive pulley 530 (see FIG. 4) is the second reference distance or less, the dishwasher 1 determines that the vane assembly 400 reaches the third position P3. In addition, when the product of the rotational displacement by which the vane assembly 400 rotates in the second rotation direction and the radius of the drive pulley 530 (see FIG. 4) is less than the second reference distance, the dishwasher 1 determines that the vane assembly 400 does not reach the third position.

When the vane assembly 400 reaches the third position P3 (YES in 1430), the dishwasher 1 moves the vane assembly 400 in the first direction D1 (1440). Specifically, the dishwasher 1 may operate the vane driving motor 520 (see FIG. 4) in the first rotation direction.

Then, the dishwasher 1 determines whether the vane assembly 400 reaches the first position P1 (1450).

The dishwasher 1 may determine whether the vane assembly 400 reaches the first position P1 through various methods.

For example, the dishwasher 1 may determine whether the vane assembly 400 reaches the first position P1 according to whether a time for which the vane driving motor 520 (see FIG. 4) rotates in the first direction D1 is the second reference time or more.

As another example, when the vane driving motor 520 (see FIG. 4) includes an encoder, the dishwasher 1 may determine whether the vane assembly 400 reaches the first position P1 according to whether the product of the rotational displacement by which the vane driving motor 520 (see FIG. 4) rotates in the first direction D1 and a radius of the drive pulley 530 in FIG. 4 is the second reference distance or more.

As still another example, when the dishwasher 1 includes the position detector 130 (see FIG. 9), the dishwasher 1 may determine whether the vane assembly 400 reaches the first position P1 according to whether a position detection sensor positioned at the first position P1 detects a position identification member attached to the vane assembly 400.

When the vane assembly 400 reaches the first position P1 (YES in 1450), the dishwasher 1 finishes forward and backward movements of the vane assembly 400.

In the washing process, the dishwasher 1 may move the vane assembly 400 forward and backward between the first position P1 and the second position P2 and between the first position P1 and the third position P3 by repeating such a vane movement method 1400.

In addition, the washing capability in the vane no-movement section 12 (see FIG. 12) may be improved by additionally moving the vane assembly 400 forward and backward in the vane rotation section 13.

Figure 20:
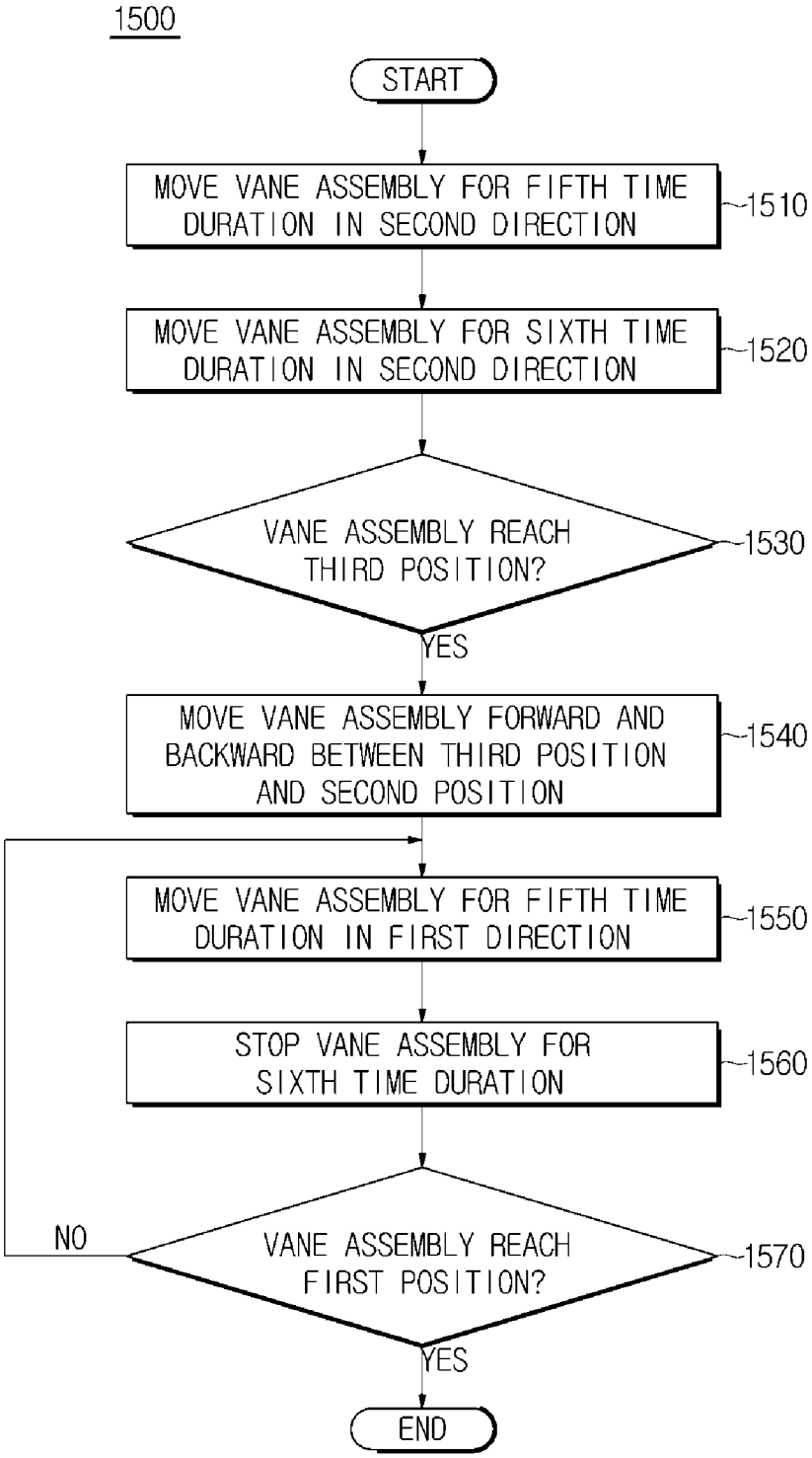
FIG. 20 is a view illustrating a vane movement method according to yet another embodiment.

FIG. 20 is a view illustrating a vane movement method according to yet another embodiment.

A vane movement method illustrated in FIG. 20 includes repeating moving and stopping of the vane assembly 400 in the vane rotation section 13 (see FIG. 13) to improve capability of washing dishes accommodated in the vane no-movement section 12.

The vane movement method 1500 will be described in detail with reference to FIGS. 17, 18, and 20.

First, the dishwasher 1 moves the vane assembly 400 in the second direction D2 for a fifth time duration (1510). Specifically, the dishwasher 1 may operate the vane driving motor 520 (see FIG. 4) for the fifth time duration in the second rotation direction.

The fifth time duration may refer to a time for which the vane assembly 400 moves in the vane rotation section 13 in the forward direction (here, the second direction D2), and may be differently set according to the second reference time for which the vane assembly 400 moves from the first position P1 to the third position P3. However, for example, when the second reference time is approximately 0.5 seconds, the fifth time duration may be set to approximately 0.1 second.

Then, the dishwasher 1 stops the vane assembly 400 for a sixth time duration (1520). Specifically, the dishwasher 1 may stop the vane driving motor 520 (see FIG. 4) for the sixth time duration.

The sixth time duration may refer to a time for which the vane assembly 400 stops a movement in the vane rotation section 13, and may be differently set according to the second reference time and the fifth time duration. For example, when the second reference time is approximately 0.5 seconds and the fifth time duration is approximately 0.1 second, the sixth time duration may be set to approximately 0.1 second.

Then, the dishwasher 1 determines whether the vane assembly 400 reaches the third position P3 (1530).

The dishwasher 1 may determine whether the vane assembly 400 reaches the third position P3 through various methods.

For example, the dishwasher 1 may accumulate the fifth time duration, and may determine whether the vane assembly 400 reaches the third position P3 according to whether the accumulated time is the second reference time or more.

As another example, the dishwasher 1 may accumulate a distance that the vane moves, and may determine whether the vane assembly 400 reaches the third position P3 according to whether the accumulated distance is the second reference distance or more.

When the vane assembly 400 does not reach the third position (NO in 1530), the dishwasher 1 repeats moving and stopping of the vane assembly 400 between the first position P1 and the third position P3.

When the vane assembly 400 reaches the third position P3 (YES in 1530), the dishwasher 1 moves the vane assembly 400 forward and backward between the first position P1 and the second position P2 (1540).

Here, the forward and backward movements between the third position P3 and the second position P2 may be one among the vane movement method 1100 illustrated in FIG. 14, the vane movement method 1200 illustrated in FIG. 15, or the vane movement method 1300 illustrated in FIG. 16. In addition, the forward and backward movements between the third position P3 and the second position P2 may also be a vane movement method excluding the vane movement methods 1100, 1200, and 1300 respectively illustrated in FIGS. 14, 15, and 16.

When the vane assembly 400 moves forward and backward between the third position P3 and the second position P2 and reaches the third position P3, the dishwasher 1 moves the vane assembly 400 for the fifth time duration in the first direction D1 (1550). Specifically, the dishwasher 1 may operate the vane driving motor 520 (see FIG. 4) for the fifth time duration in the first rotation direction.

The fifth time duration may refer to a time for which the vane assembly 400 moves, and may be different from the fifth time duration in 1510.

Then, the dishwasher 1 stops the vane assembly for the sixth time duration (1560). Specifically, the dishwasher 1 may stop the vane driving motor 520 (see FIG. 4) for the sixth time duration.

The sixth time duration may refer to a time for which the vane assembly 400 stops a movement, and may be different from the sixth time duration in 1520.

Then, the dishwasher 1 determines whether the vane assembly 400 reaches the first position P1 (1570).

The dishwasher 1 may determine whether the vane assembly 400 reaches the first position P1 through various methods.

For example, the dishwasher 1 may accumulate the fifth time duration, and may determine whether the vane assembly 400 reaches the first position P1 according to whether the accumulated time is the second reference time or more.

As another example, when the dishwasher 1 includes an encoder attached to the vane driving motor 520 (see FIG. 4), the dishwasher 1 may accumulate a distance that the vane assembly 400 moves, and may determine whether the vane assembly 400 reaches the first position P1 according to whether the accumulated distance is the second reference distance or more.

As still another example, when the dishwasher 1 includes a position identification member attached to the vane assembly 400 and a position detection sensor provided at the first position P1, the dishwasher 1 may determine whether the vane assembly 400 reaches the first position P1 according to whether the position detection sensor provided at the first position P1 detects the position identification member.

When the vane assembly 400 does not reach the first position P1 (NO in 1570), the dishwasher 1 repeats moving and stopping of the vane assembly 400 between the third position P3 and the first position P1.

When the vane assembly 400 reaches the first position P1 (YES in 1570), the dishwasher 1 finishes the movement of the vane assembly 400.

In the washing process, the dishwasher 1 may move the vane assembly 400 forward and backward by repeating such a vane movement method 1500.

In addition, the dishwasher 1 may improve capability of washing dishes accommodated in the vane no-movement section 12 (see FIG. 12) by repeating moving and stopping of the vane assembly 400 while the vane assembly 400 is moving forward and backward in the vane rotation section 13 (see FIG. 12).

Figure 21:
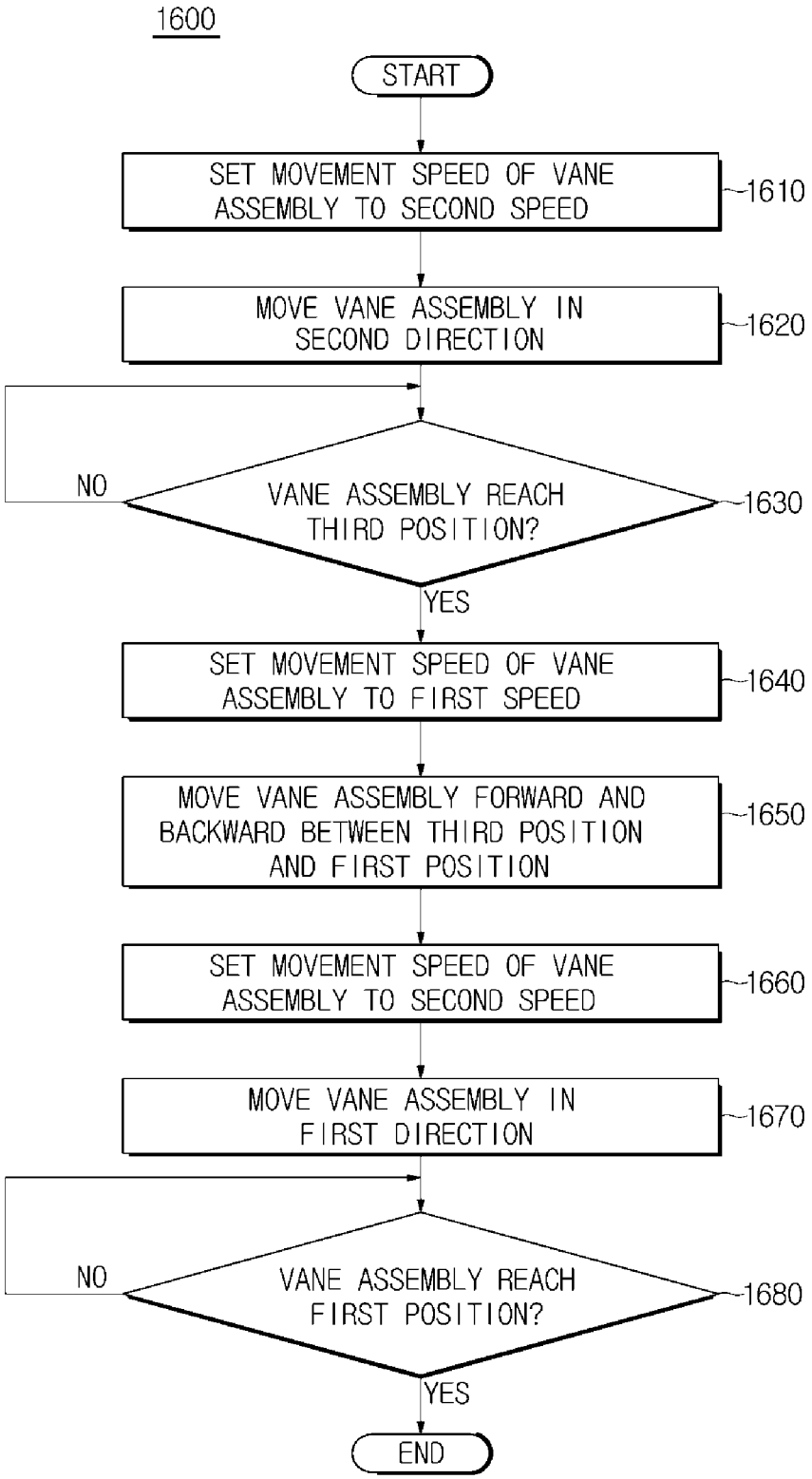
FIG. 21 is a view illustrating a vane movement method according to yet another embodiment.

FIG. 21 is a view illustrating a vane movement method according to yet another embodiment.

A vane movement method 1600 illustrated in FIG. 21 includes reducing a movement speed of the vane assembly 400 in the vane rotation section 13 (see FIG. 13) to improve capability of washing dishes accommodated in the vane no-movement section 12.

The vane movement method 1600 will be described in detail with reference to FIGS. 17, 18, and 21.

First, the dishwasher 1 sets a movement speed of the vane assembly 400 to a movement speed in the vane rotation section 13 (see FIG. 12) (hereinafter, referred to as a second speed) (1610).

Specifically, when the vane driving motor 520 (see FIG. 4) is a DC motor, the dishwasher 1 may change the movement speed of the vane assembly 400 by changing a driving current level supplied to the vane driving motor 520 (see FIG. 4). In addition, when the vane driving motor 520 (see FIG. 4) is an AC motor, the dishwasher 1 may change the movement speed of the vane assembly 400 by changing a frequency of the driving current supplied to the vane driving motor 520 (see FIG. 4).

The second speed is a speed at which the vane assembly 400 moves in the vane rotation section 13 (see FIG. 12), and it is preferable that the second speed be slower than a speed at which the vane moves in the vane movement section 11 (see FIG. 12) excluding the vane rotation section 13 (see FIG. 13) (hereinafter, referred to as a first speed).

Then, the dishwasher 1 moves the vane assembly 400 in the second direction D2 (1620). Specifically, the dishwasher 1 may operate the vane driving motor 520 (see FIG. 4) in the second rotation direction.

Then, the dishwasher 1 determines whether the vane assembly 400 reaches the third position P3 (1630).

The dishwasher 1 may determine whether the vane assembly 400 reaches the third position P3 through various methods.

For example, the dishwasher may determine whether the vane assembly 400 reaches the third position P3 according to whether a time for which the vane driving motor 520 (see FIG. 4) operates in the second rotation direction is equal to or greater than a value of the second reference distance divided by the second speed.

As another example, when the vane driving motor 520 (see FIG. 4) includes an encoder, the dishwasher 1 may determine whether the vane assembly 400 reaches the third position P3 according to whether a product of a rotational displacement by which the vane driving motor 520 (see FIG. 4) rotates in the second rotation direction and the radius of the drive pulley 530 (see FIG. 4) is the second reference distance or more.

When the vane assembly 400 reaches the third position P3 (YES in 1630), the dishwasher 1 sets the movement speed of the vane assembly 400 to the first speed (1640).

The first speed is a speed at which the vane assembly 400 moves in the vane movement section 11 (see FIG. 12) excluding the vane rotation section 13 (see FIG. 12), and it is preferable that the first speed be faster than the second speed.

Then, the dishwasher 1 moves the vane assembly 400 forward and backward between the third position P3 and the second position P2 (1650).

Here, the forward and backward movements between the third position P3 and the second position P2 may be one among the vane movement method 1100 illustrated in FIG. 14, the vane movement method 1200 illustrated in FIG. 15, or the vane movement method 1300 illustrated in FIG. 16. In addition, the forward and backward movements between the first position P1 and the second position P2 may also be a vane movement method excluding the vane movement methods 1100, 1200, and 1300 respectively illustrated in FIGS. 14, 15, and 16.

When the vane assembly 400 moves forward and backward between the third position P3 and the second position P2 and reaches the third position P3, the dishwasher 1 sets the movement speed of the vane assembly 400 to the second speed (1660).

Then, the dishwasher 1 moves the vane assembly in the first direction D1 (1670). Specifically, the dishwasher 1 may operate the vane driving motor 520 (see FIG. 4) in the first rotation direction.

Then, the dishwasher 1 determines whether the vane assembly 400 reaches the first position P1 (1680).

The dishwasher 1 may determine whether the vane assembly 400 reaches the first position P1 through various methods.

For example, the dishwasher may determine whether the vane assembly 400 reaches the first position P1 according to whether a time for which the vane driving motor 520 (see FIG. 4) operates in the first rotation direction is equal to or greater than a value of the second reference distance divided by the second speed.

As another example, when the vane driving motor 520 (see FIG. 4) includes an encoder, whether the vane assembly 400 reaches the first position P1 may be determined according to whether a product of a rotational displacement by which the vane driving motor 520 (see FIG. 4) rotates in the first rotation direction and the radius of the drive pulley 530 (see FIG. 4) is the second reference distance or more.

As still another example, when the dishwasher 1 includes the position detector 130 (see FIG. 9), the dishwasher 1 may determine whether the vane assembly 400 reaches the first position P1 according to whether a position detection sensor positioned at the first position P1 detects a position identification member attached to the vane assembly 400.

In the washing process, the dishwasher 1 may move the vane assembly 400 forward and backward by repeating such a vane movement method 1600.

In addition, the dishwasher 1 may improve capability of washing dishes accommodated in the vane no-movement section 12 (see FIG. 12) by reducing a movement speed of the vane assembly 400 while the vane assembly 400 is moving in the vane rotation section 13 (see FIG. 12).

Figure 22:
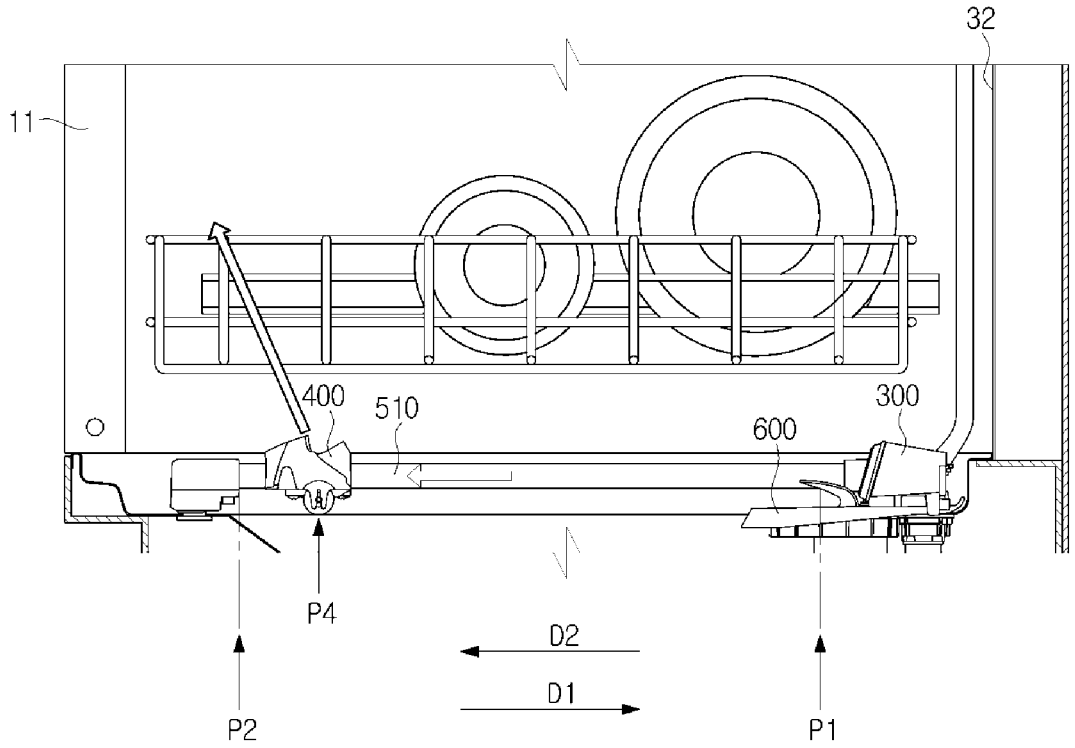
FIG. 22 is a view illustrating a trajectory of washing water when dishes are not accommodated at a side of a door of the dishwasher according to one embodiment.

FIG. 22 is a view illustrating a trajectory of washing water when dishes are not accommodated at a side of a door of the dishwasher according to one embodiment.

Referring to FIG. 22, when dishes are not accommodated near the door 11 of the dishwasher 1, washing water reflected by the vane assembly 400 may directly strike the door 11.

When washing water reflected by the vane assembly 400 directly strikes the door 11, there is a concern that vibrations and noise of the dishwasher 1 increase. Specifically, when the vane assembly 400 is positioned near the second position P2, there is high possibility of washing water reflected by the vane assembly 400 striking the door 11.

When dishes are not accommodated near the door 11, the dishwasher 1 may move the vane assembly 400 to a position at which washing water reflected by the vane assembly 400 in the first position P1 does not strike the door 11 (hereinafter, referred to as a fourth position).

Figure 23:
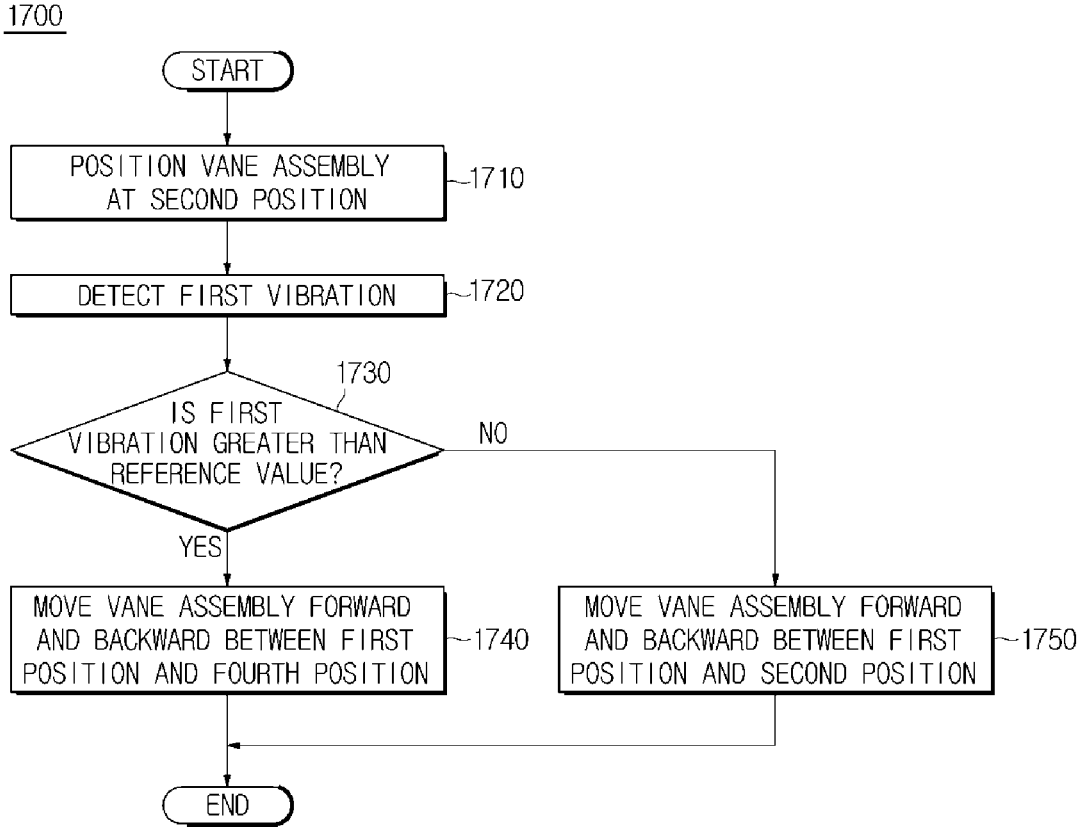
FIG. 23 is a view illustrating a vane movement method according to yet another embodiment.

FIG. 23 is a view illustrating a vane movement method according to yet another embodiment.

A vane movement method 1700 illustrated in FIG. 23 includes moving the vane assembly 400 between the first position P1 and a fourth position P4 when it is determined that washing water reflected by the vane assembly 400 strikes the door 11.

The vane movement method 1700 will be described with reference to FIGS. 22 and 23.

First, the dishwasher 1 positions the vane assembly 400 at the second position P2 (1710). For example, when the vane assembly 400 is positioned at the first position P1, the dishwasher 1 may position the vane assembly 400 at the second position P2 by operating the vane driving motor 520 (see FIG. 4) for the first reference time or more in the second rotation direction.

Then, the dishwasher 1 detects a first vibration of the door 11 (1720). Specifically, the dishwasher 1 may detect the first vibration through a vibration sensor attached to the door 11.

Then, the dishwasher 1 determines whether the first vibration exceeds a predetermined reference value (1730). Here, the reference value may be set to a value of a vibration value generated when dishes are accommodated near the door 11 of the dishwasher 1 added to a tolerance. In addition, the tolerance refers to a deviation of vibrations generated when washing water that strikes the dishes strikes the door again.

When the first vibration is greater than the reference value (YES in 1730), the dishwasher 1 moves the vane assembly 400 forward and backward between the first position P1 and the fourth position P4 (1740).

The first vibration generated when the vane assembly 400 is positioned at the second position P2 being greater than the reference value refers to washing water reflected by the vane assembly 400 directly striking the door 11 because dishes are not accommodated near the door 11.

Accordingly, the dishwasher 1 moves the vane assembly 400 to the fourth position P4 at which the washing water reflected by the vane assembly 400 does not directly strike the door 11.

When the first vibration is not greater than the reference value (NO in 1730) the dishwasher 1 moves the vane assembly 400 forward and backward between the first position P1 and the second position P2 (1750).

A vibration generated when the vane assembly 400 is positioned at the second position P2 being the reference value or less refers to the washing water reflected by the vane assembly 400 not directly striking the door 11 because dishes are accommodated near the door 11.

Accordingly, the dishwasher 1 moves the vane assembly 400 to the second position P2 corresponding to an end of the vane movement section 11 (see FIG. 12) in a direction of the door 11 to wash the dishes near the door 11.

Through such a vane movement method 1700, the dishwasher 1 may reduce noise by preventing washing water from directly striking the door 11.

Figure 24:
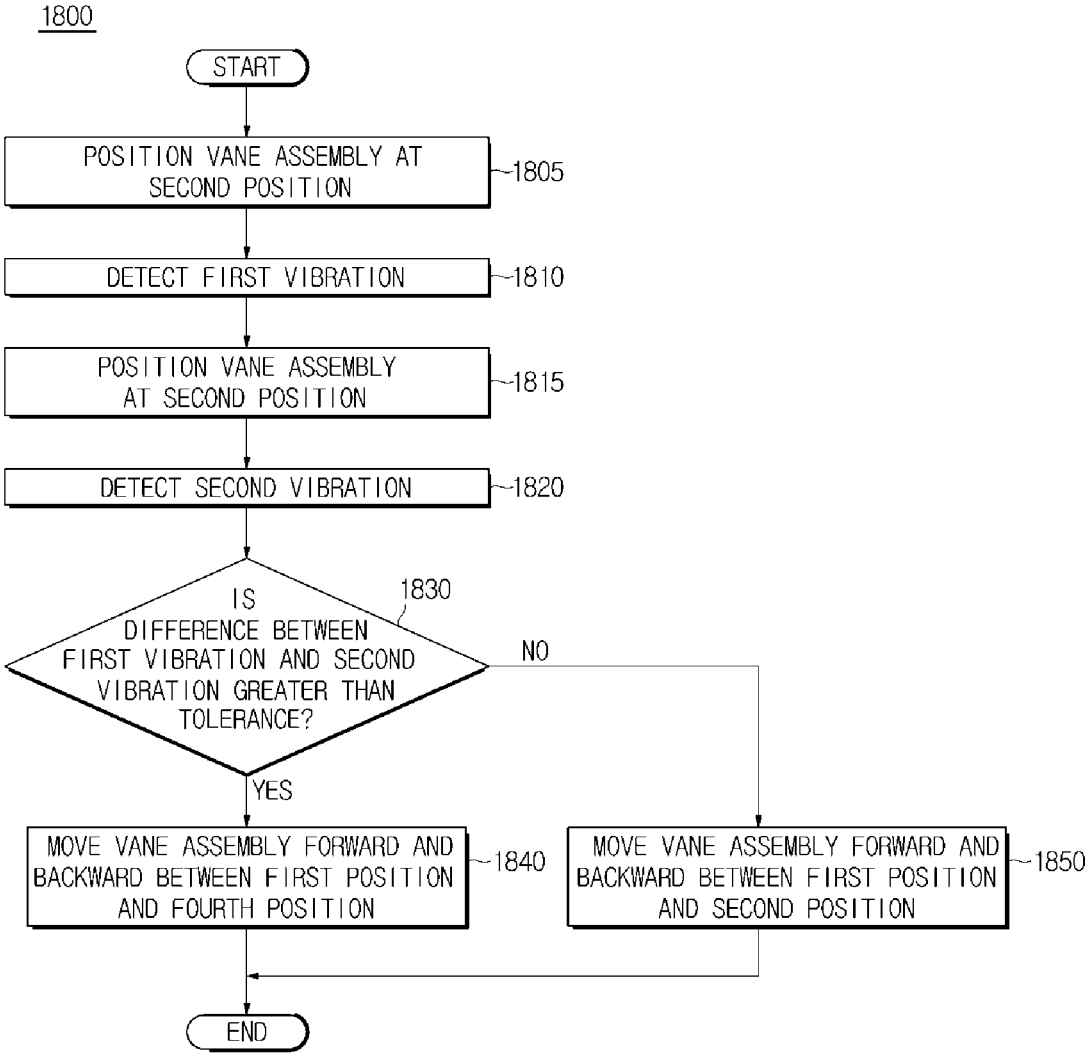
FIG. 24 is a view illustrating a vane movement method according to yet another embodiment.

FIG. 24 is a view illustrating a vane movement method according to yet another embodiment.

A vane movement method 1800 will be described with reference to FIGS. 22 and 24.

First, the dishwasher 1 positions the vane assembly 400 at the second position P2 (1805). For example, when the vane assembly 400 is positioned at the first position P1, the dishwasher 1 may position the vane assembly 400 at the second position P2 by operating the vane driving motor 520 (see FIG. 4) for the first reference time or more in the second rotation direction.

Then, the dishwasher 1 detects a first vibration of the door 11 (1810). Specifically, the dishwasher 1 may detect the first vibration through a vibration sensor attached to the door 11.

Then, the dishwasher 1 positions the vane assembly 400 at the fourth position P4 (1815). For example, when the vane assembly 400 is positioned at the second position P2, the dishwasher 1 may position the vane assembly 400 at the fourth position P4 by operating the vane driving motor 520 (see FIG. 4) in the first rotation direction.

Then, the dishwasher 1 detects a second vibration of the door 11 (1820). Specifically, the dishwasher 1 may detect the second vibration through a vibration sensor attached to the door 11.

Then, the dishwasher 1 determines whether a difference between the first vibration and the second vibration is greater than a tolerance (1830). Here, the tolerance refers to a deviation of vibrations that may be generated when washing water that strikes dishes strikes the door 11 again.

When the difference between the first vibration and the second vibration is greater than the tolerance (YES in 1830), the dishwasher 1 moves the vane assembly 400 forward and backward between the first position P1 and the fourth position P4 (1840).

The difference between the first vibration and the second vibration being greater than the tolerance refers to washing water reflected by the vane assembly 400 directly striking the door 11 because dishes are not accommodated near the door 11. Accordingly, the dishwasher 1 moves the vane assembly 400 to the fourth position P4 at which the washing water reflected by the vane assembly 400 does not directly strike the door 11.

When the difference between the first vibration and the second vibration is not greater than the tolerance (NO in 1830), the dishwasher 1 moves the vane assembly 400 forward and backward between the first position P1 and the second position P2 (1850).

The difference between the first vibration and the second vibration being within the tolerance refers to washing water reflected by the vane assembly 400 not directly striking the door 11 because dishes are accommodated near the door 11.

Accordingly, the dishwasher 1 moves the vane assembly 400 to the second position P2 corresponding to an end of the vane movement section 11 (see FIG. 12) in the direction of the door 11 to wash the dishes near the door 11.

Through such a vane movement method 1800, the dishwasher 1 may reduce noise by preventing washing water from directly striking the door 11.

Figure 25:
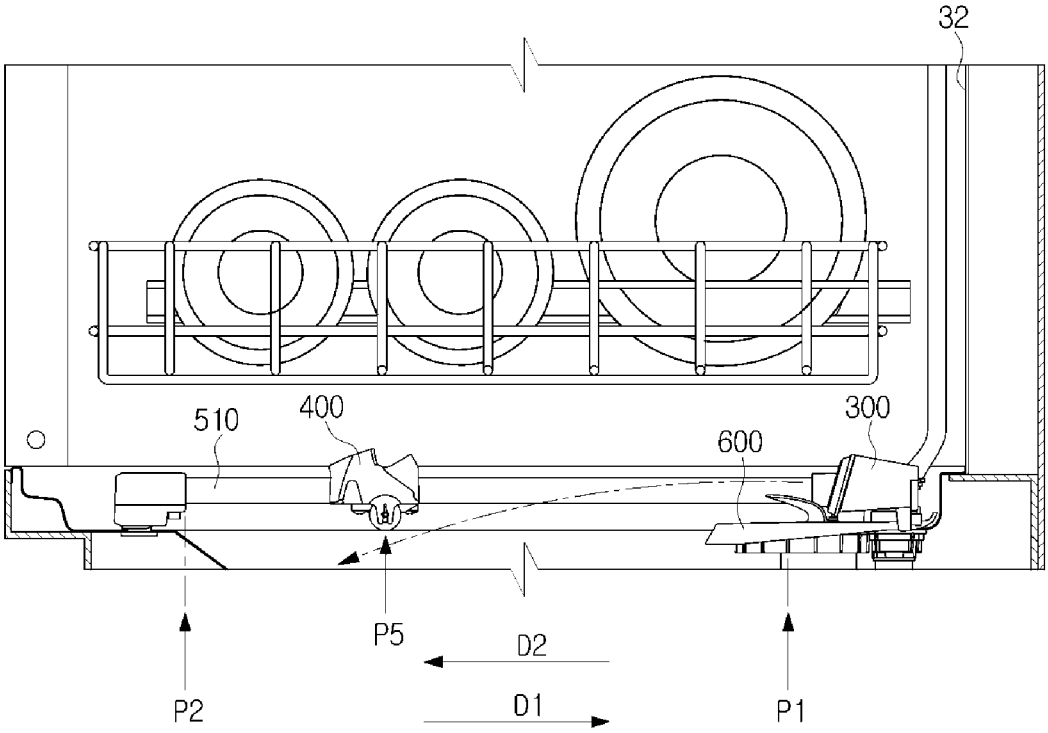
FIG. 25 is a view illustrating a trajectory of washing water when a distribution mode of the dishwasher is changed according to one embodiment.

FIG. 25 is a view illustrating a trajectory of washing water when a distribution mode of the dishwasher is changed according to one embodiment.

As described above, the dishwasher 1 may be operated in a plurality of washing water distribution modes. For example, the dishwasher may be operated in a first distribution mode for supplying washing water only to the rotary spray nozzles 61 and 63 (see FIG. 3), a second distribution mode for supplying washing water only to the right fixed nozzle 340, a third distribution mode for supplying washing water to the left and right fixed nozzles 330 and 340, or a fourth distribution mode for supplying washing water only to the left fixed nozzle 330.

When a distribution mode of the dishwasher 1 is changed, the distribution valve assembly 200 (see FIG. 3) that distributes washing water closes and reopens a flow path for supplying the washing water to the fixed nozzle assembly 300.

For example, when changing from the second distribution mode to the third distribution mode, a flow path for supplying washing water to the right fixed nozzle 340 in the second and third distribution modes is closed and reopened. Accordingly, a pressure of the washing water sprayed from the right fixed nozzle 340 decreases, and a spray distance of the washing water decreases accordingly as illustrated in FIG. 25. In addition, a flow path for supplying the washing water to the left fixed nozzle 330 is opened in the third distribution mode, a pressure of the washing water sprayed from the left fixed nozzle 330 decreases right after the flow path is opened, and the spray distance of the washing water decreases accordingly as illustrated in FIG. 25.

When the spray distance of the washing water decreases and the vane assembly 400 is positioned farther away than a decreased distance from the first position P1, the washing water directly strikes the bottom plate 35 of the tub 30 and generates vibrations and noise.

In other words, when a distribution mode is changed and the vane assembly 400 is positioned beyond a position at which washing water reaches from the fixed nozzle assembly 300 (here, referred to as a fifth position), the washing water directly strikes the bottom plate 35 of the tub 30.

Figure 26:
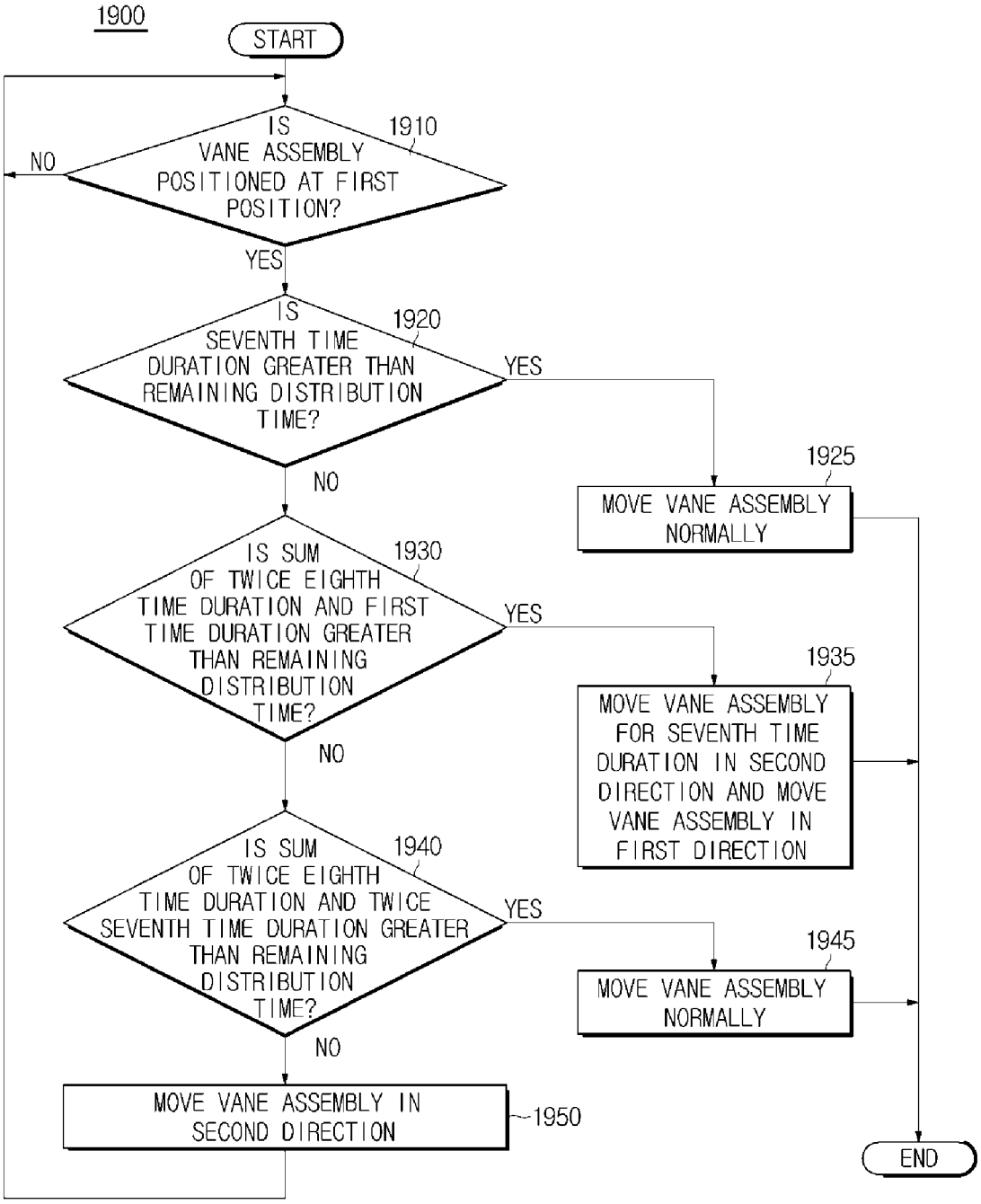
FIG. 26 is a view illustrating a vane movement method according to yet another embodiment.

FIG. 26 is a view illustrating a vane movement method according to yet another embodiment.

A vane movement method 1900 illustrated in FIG. 26 includes controlling a movement of the vane assembly 400 according to remaining distribution time to a distribution mode change of the dishwasher 1 (hereinafter, referred to as the remaining distribution time).

The vane movement method 1900 will be described with reference to FIGS. 25 and 26.

First, the dishwasher 1 determines whether the vane assembly 400 is positioned at the first position P1 (1910).

For example, the dishwasher 1 may determine whether the vane assembly 400 is positioned at the first position P1 according to whether the vane driving motor 520 (see FIG. 4) is operated in the first rotation direction for the first reference time or more.

In addition, the dishwasher 1 may determine whether the vane assembly 400 is positioned at the first position P1 according to whether a product of a rotational displacement by which the vane driving motor 520 (see FIG. 4) rotates in the first rotation direction and the radius of the drive pulley 530 (see FIG. 4) is the first reference distance or more.

In addition, the dishwasher 1 may determine whether the vane assembly 400 is positioned at the first position P1 according to whether a position detection sensor positioned at the first position P1 detects a position identification member attached to the vane assembly 400.

When it is determined that the vane assembly 400 is positioned at the first position P1 (YES in 1910), the dishwasher 1 determines whether a remaining distribution time is less than a seventh time duration (1920). Here, the seventh time duration refers to a time for which the vane assembly 400 moves from the first position P1 to a fifth position P5.

When the remaining distribution time is less than the seventh time duration (YES in 1920), the dishwasher 1 moves the vane assembly 400 normally (1925). When the remaining distribution time is less than the seventh time duration, since the vane assembly 400 is positioned within a spray distance of washing water of the fixed nozzle assembly 400 even when a distribution mode is changed after the remaining distribution time is elapsed, the dishwasher 1 operates the vane assembly 400 normally.

When the remaining distribution is the seventh time duration or more (NO in 1920), the dishwasher 1 determines whether the remaining distribution time is less than a time that is the sum of twice an eighth time duration and the seventh time duration (1930). Here, the eighth time duration refers to a time for which the vane assembly 400 moves from the fifth position P5 to the second position P2. That is, the sum of the seventh time duration and the eighth time duration is equal to the first reference time.

In addition, when the vane assembly 400 moves from the first position P1 for a time that is the sum of twice the eight time duration and the seventh time duration, the vane assembly 400 is positioned at the fifth position P5.

When the remaining distribution time is less than a time that is the sum of twice the sight time duration and the seventh time duration (YES in 1930), the dishwasher 1 moves the vane assembly 400 for the seventh time duration in the second direction, and moves the vane assembly 400 for the left-over remaining distribution time in the first direction (1935).

When the remaining distribution time is the seventh time duration or more and is less than a time that is the sum of twice the eighth time duration and the seventh time duration and the vane assembly 400 moves forward and backward for the remaining distribution time, the vane assembly 400 is positioned beyond a spray distance of washing water of the fixed nozzle assembly 300 when a distribution mode is changed.

Accordingly, the dishwasher 1 moves the vane assembly 400 only for the seventh time duration in the second direction D2, and moves the vane assembly 400 for the remaining distribution time duration in the first direction D1.

Although not illustrated in FIG. 26, the vane assembly 400 may also be positioned at the first position P1 for the remaining distribution time. That is, by positioning the vane assembly 400 at the first position P1 for the remaining distribution time, the vane assembly 400 is prevented from being positioned beyond a spray distance of washing water of the fixed nozzle assembly 300 when a distribution mode is changed.

When the remaining distribution time is equal to or greater than a time that is the sum of twice the eighth time duration and the seventh time duration (NO in 1930), the dishwasher 1 determines whether the remaining distribution time is less than a time that is the sum of twice the eighth time duration and twice the seventh time duration (1940).

When the vane assembly 400 moves for a time that is the sum of twice the eighth time duration and twice the seventh time duration from the first position P1, the vane assembly 400 is positioned at the first position P1 again.

When the remaining distribution time is less than a time that is the sum of twice the eighth time duration and twice the seventh time duration (YES in 1940), the dishwasher 1 moves the vane assembly 400 normally (1925). When the remaining distribution time is less than a time that is the sum of twice the eighth time duration and twice the seventh time duration, the dishwasher 1 operates the vane assembly 400 normally since the vane assembly 400 is positioned within a spray distance of washing water of the fixed nozzle assembly 300 after the remaining distribution time is elapsed.

When the remaining distribution time is equal to or greater than a time that is the sum of twice the eighth time duration and twice the seventh time duration (NO in 1940), the dishwasher 1 moves the vane assembly 400 in the first direction D1 (1950). That is, since the remaining distribution time is greater than a time for which the vane assembly 400 moves forward and backward, the dishwasher 1 defers determination and operates the vane assembly 400 normally.

Through such a vane movement method 1900, the dishwasher 1 may reduce noise by preventing washing water from directly striking the bottom plate 35 when a distribution mode is changed.

However, the method is not limited thereto, to prevent washing water from directly striking the bottom plate 35 when a distribution mode is changed, a movement of the vane assembly may be stopped for the remaining distribution time when the vane assembly 400 is positioned at the first position P1 and the remaining distribution time is less than twice the first reference time (a time for which the vane assembly 400 moves between the first position P1 and the second position P2). That is, the vane assembly 400 may be positioned at the first position P1 for the remaining distribution time.

While the embodiments of the present disclosure have been illustrated and described above description, the disclosure is not limited to the above-described specific embodiments, and variously modified embodiments may be made by those skilled in the art without departing from the gist of the disclosure claimed by the appended claims and the modified embodiments may not be separately understood from the disclosure.

The invention claimed is:

1. A control method of a dishwasher comprising:

spraying, by a nozzle assembly disposed adjacent to a first position, washing water; and moving a vane assembly along a first axis between the first position and a second position, the vane assembly including a vane configured to redirect washing water sprayed by the nozzle assembly toward a dish, wherein the moving of the vane assembly between the first position and the second position includes:

when the vane assembly approaches the first position from the second position, rotating the vane around a second axis perpendicular to the first axis to redirect the washing water sprayed by the nozzle assembly toward a dish placed above the nozzle assembly.

2. The control method of claim 1, further comprising moving the vane assembly from the second position to the first position when the vane assembly reaches the second position.

3. The control method of claim 1, wherein the moving of the vane assembly between the first position and the second position includes:

moving the vane assembly for a first time duration in a forward direction; and moving the vane assembly for a second time duration in a backward direction, wherein:

the first time duration is less than a reference time, and the second time duration is less than the first time duration.

4. The control method of claim 1, wherein the moving of the vane assembly between the first position and the second position includes:

moving the vane assembly for a third time duration; and stopping the vane assembly for a fourth time duration, wherein the third time duration is less than a reference time.

5. The control method of claim 1, wherein a vane movement section between the first position and the second position includes a vane rotation section in which the vane assembly redirects the washing water sprayed by the nozzle assembly toward the dish placed above the nozzle assembly.

6. The control method of claim 5, further comprising repeating moving and stopping of the vane assembly when the vane assembly is positioned in the vane rotation section.

7. The control method of claim 5, further comprising reducing the movement speed of the vane assembly when the vane assembly is positioned in the vane rotation section.

8. The control method of claim 1, further comprising moving the vane assembly from the first position to a third position when a vibration of the dishwasher is a reference value or more.

* * * * *